US012638265B2

(12) United States Patent
Turley

(10) Patent No.: US 12,638,265 B2
(45) Date of Patent: May 26, 2026

(54) WRIST STRAP TRIGGER-ACTUATED SAFETY RELEASE

(71) Applicant: True Form Archery LLC, Sheffield Lake, OH (US)

(72) Inventor: Paul E. Turley, Amherst, OH (US)

(73) Assignee: True Form Archery LLC, Sheffield Lake, OH (US)

( * ) Notice: Subject to any disclaimer, the term of this patent is extended or adjusted under 35 U.S.C. 154(b) by 169 days.

(21) Appl. No.: 18/768,263

(22) Filed: Jul. 10, 2024

(65) Prior Publication Data

US 2025/0020429 A1 Jan. 16, 2025

Related U.S. Application Data

(60) Provisional application No. 63/513,125, filed on Jul. 12, 2023.

(51) Int. Cl.
*F41B 5/14* (2006.01)

(52) U.S. Cl.
CPC ..... *F41B 5/1469* (2013.01)

(58) Field of Classification Search
CPC ..... F41B 5/1469; F41B 5/1473
USPC ..... 124/35.1, 35.2, 37, 36
See application file for complete search history.

(56) References Cited

U.S. PATENT DOCUMENTS

| | | | | |
|---|---|---|---|---|
| 4,574,767 A * | 3/1986 | Gazzara | F41B 5/1469 124/35.2 |
| 7,240,672 B2 * | 7/2007 | Peck | F41B 5/1469 124/35.2 |
| 8,522,764 B1 * | 9/2013 | LoRocco | F41B 5/1469 124/35.2 |
| 10,012,467 B2 | 7/2018 | Meadows | |

* cited by examiner

*Primary Examiner* — Reginald S Tillman, Jr.
(74) *Attorney, Agent, or Firm* — Sand, Sebolt & Wernow Co., LPA

(57) ABSTRACT

An archery release for firing an arrow from a bow. The archery release includes a main body, a jaw assembly that operably engages with the main body and is adapted to receive and hold a D-loop formed on a bowstring, a pair of triggers that operably engages with the jaw assembly for moving the jaw assembly between a closed position and an open position, and a biaser that operably engages with the main body and at least one trigger of the pair of triggers for biasing the pair of triggers towards the closed position. The archery release also includes that when the pair of triggers moves from a first position to a second position, a first jaw component and a second jaw component of the jaw assemblies simultaneously transition from the closed positioned to the open position.

20 Claims, 15 Drawing Sheets

WRIST STRAP TRIGGER-ACTUATED SAFETY RELEASE

REFERENCE TO RELATED APPLICATIONS

This application claims the benefit of U.S. Provisional Application Ser. No. 63/513,125, filed on Jul. 12, 2023; the disclosure of which is incorporated herein by reference.

TECHNICAL FIELD

This disclosure is directed to release devices typically used as firing aids in archery.

BACKGROUND ART

Traditionally, the acts of drawing and firing archaic bows (e.g., recurve bows or composite bows) require a suitable amount of strength and dexterity in the archer. In modern archery, archers have become accustomed to drawing and firing compound bows in various archery activities, including target practice and hunting, due to the advantages of shorter bow lengths, higher draw weights, and faster arrow speeds based on lighter holding weights provided by the cams of these compounds bows. Generally, however, that act of firing compound bows still requires accuracy from the archer in drawing and releasing a bowstring of these bows while preventing inadvertent or unwanted movement of a nock point of the bowstring.

To combat against this accuracy issue, archery releases and similar archery aids are being used to assist an archer in firing of an archery bow, such as a compound bow. While such devices are becoming commonplace in the sport of archery, conventional archery releases still lack the capabilities of both accuracy and efficiency when releasing a bowstring. In one instance, some conventional archery releases may utilize a trigger finger release or thumb release to release a bowstring and to fire an arrow. In this instance, however, such trigger finger releases and thumb releases may create issues of premature fire or "trigger panic" by accidentally or inadvertently releasing the bowstring causing the arrow to travel away from an intended target.

In another instance, archer may utilize back tension archery releases that release the bowstring when a predetermined draw weight is met. In these instances, however, these conventional archery releases are difficult to learn and use when beginning archery. Upon using these back tension releases, an archer must normally hold the safety of a given back tension release to draw the bow and then release the safety after reaching full draw and lower holding force. Such back tension releases require that the archer maintain the bow at full draw while the archer must maintain a constant pressure with little variance to maximize accuracy. To fire these releases, the archer must then pull above the hold weight of the bow to release the arrow; however, such actions may cause inadvertent firing of the bow if this specific sequence is not followed.

These back tension releases may also use "hinge" style releases to hold the bowstring when drawing through the shot. These "hinge" style releases require the archer to draw the bow with the release being rotated away from the release point of the bow. Once at a full draw and the archer is ready to fire, the archer must rotate the release with their hand to release the bowstring from the release. Such movement of the archer's hand may be challenging to control both the draw cycle and the release at once when firing from an elevated position (e.g., an elevated hunting stand). Such movement of these "hinge" style releases may also cause inadvertent firing of the arrow.

SUMMARY OF THE INVENTION

In one aspect, an exemplary embodiment of the present disclosure may provide an archery release. The archery release comprises of a main body, a jaw assembly that operably engages with the main body and is adapted to receive and hold a D-loop formed on a bowstring, a pair of triggers that operably engages with the jaw assembly for moving the jaw assembly between an open position and a closed position, and a biaser that operably engages with the main body and at least one trigger of the pair of triggers for biasing the pair of triggers towards the closed position. The archery release also includes that when the pair of triggers moves from a first position to a second position, a first jaw component and a second jaw component of the jaw assemblies simultaneously transition from the closed position to the opened position.

In another aspect, an exemplary embodiment of the present disclosure may provide an archery release. The archery release may include a main body, a jaw assembly that operably engages with the main body and is adapted to receive and hold a D-loop formed on a bowstring, a pair of triggers that operably engages with the jaw assembly for moving the jaw assembly between a closed position and an open position, a safety mechanism that operably engages with at least one trigger of the pair of triggers and the main body to prevent the pair of triggers from moving from the closed position and the open position, and a biaser that operably engages with the main body and at least one trigger of the pair of triggers for biasing the pair of triggers towards the closed position. The archery release also includes that when the pair of triggers moves from a first position to a second position, a first jaw component and a second jaw component of the jaw assemblies simultaneously transition from the closed positioned to the open position.

In yet another aspect, and exemplary embodiment of the present disclosure may provide a method of firing an arrow from a bow. The method may include the steps of loading the arrow with the bow; loading a D-loop formed on a bowstring of the bow with a jaw assembly of an archery release; gripping a first trigger of a pair of triggers with a first digit; gripping a second trigger of the pair of triggers with a second digit; disengaging one or both of the first trigger and the second trigger of the pair of triggers from a safety position to a firing position; pulling the pair of triggers from a first position to a second position; opening a first jaw component and a second jaw component of the jaw assembly simultaneously; and firing the arrow from the bow.

In yet another aspect, and exemplary embodiment of the present disclosure may provide an archery release. The archery release includes a main body; a jaw assembly operably engaging with the main body that is adapted to receive and hold a D-loop formed on a bowstring; a pair of triggers operably engaging with the jaw assembly for moving the jaw assembly between an open position and a closed position; and a biaser operably engaging with the main body and at least one trigger of the pair of triggers for biasing the pair of triggers towards the closed position; wherein when the pair of triggers moves from a first position to a second position, a first jaw and a second jaw of the jaw assembly simultaneously transition from the closed position to the open position.

This exemplary embodiment or another exemplary embodiment may further include a safety mechanism operably engaging with a first trigger or a second trigger of the pair of triggers and the main body; wherein the safety mechanism is configured to prevent the pair of triggers from moving from the closed position to the open position. This exemplary embodiment or another exemplary embodiment may further include that the safety mechanism comprises: a safety member extending from the first trigger or the second trigger of the pair of triggers that is configured to engage with the main body. This exemplary embodiment or another exemplary embodiment may further include that the safety mechanism comprises: a safety aperture defined in the main body, wherein the safety member is operably engageable with the main body inside of the safety aperture. This exemplary embodiment or another exemplary embodiment may further include that when the safety member is positioned inside of the safety aperture, the archery release is provided in a safety position. This exemplary embodiment or another exemplary embodiment may further include that when the safety member is positioned outside of the safety aperture, the archery release is provided in a firing position. This exemplary embodiment or another exemplary embodiment may further include that the pair of triggers further comprises: a first base of a first trigger component of the pair of triggers that operably engages with the jaw assembly and with the biaser inside of said main body; and a first trigger of the first trigger component of the pair of triggers that operably engages with the first base and is positioned external to the main body. This exemplary embodiment or another exemplary embodiment may further include that the pair of triggers further comprises: a second base of a second trigger component of the pair of triggers that operably engages with the jaw assembly and is positioned inside of the first base of the first trigger component; and a second trigger of the second trigger component of the pair of triggers that operably engages with the second base and is positioned external to the main body, the second trigger having a safety members that operably engages with the main body to prevent the pair of triggers from moving from the closed position to the open position. This exemplary embodiment or another exemplary embodiment may further include a trigger biaser extending from the first base and being received by the second base; wherein the trigger biaser is configured to maintain the pair of triggers in the closed position. This exemplary embodiment or another exemplary embodiment may further include that the jaw assembly further comprises: a trigger link operably engaging with the pair of triggers; a first cam link operably engaging the first jaw with the trigger link; and a second cam link operably engaging the second jaw with the trigger link. This exemplary embodiment or another exemplary embodiment may further include that the jaw assembly further comprises: a first dowel pivotably engaging the first jaw and the first cam link with one another; a second dowel pivotably engaging the second jaw and the second cam link with one another; and a third dowel pivotably engaging the first cam link, the second cam link, and the trigger link with one another. This exemplary embodiment or another exemplary embodiment may further include that main body further comprises: a peg extending from the main body and is positioned longitudinally behind the jaw assembly, the pair of triggers, and the biaser; wherein the peg is aligned with one of the triggers of the pair of triggers. This exemplary embodiment or another exemplary embodiment may further include a wrist strap assembly pivotably engaging with the main body and positioned longitudinally behind the jaw assembly and the pair of triggers.

In yet another aspect, and exemplary embodiment of the present disclosure may provide a method of firing an arrow from a bow. The method includes steps of: loading the arrow with the bow; loading a D-loop formed on a bowstring of the bow with a jaw assembly of an archery release; gripping a first trigger of a pair of triggers with a first digit; gripping a second trigger of the pair of triggers with a second digit; pulling the pair of triggers from a first position to a second position; opening a first jaw component and a second jaw component of the jaw assembly simultaneously; and firing the arrow from the bow.

This exemplary embodiment or another exemplary embodiment may further include a step of disengaging one or both of the first trigger and the second trigger of the pair of triggers from a safety position to a firing position. This exemplary embodiment or another exemplary embodiment may further include that step of disengaging one or both of the first trigger and the second trigger of the pair of triggers from the safety position to the firing position further comprising: removing a safety member that is disposed on one of the first trigger and the second trigger from a safety aperture defined in main body. This exemplary embodiment or another exemplary embodiment may further include a step of biasing the pair of triggers to the safety position by a trigger biaser. This exemplary embodiment or another exemplary embodiment may further include step of connecting a first cam link with a trigger link and the first jaw component; connecting a second cam link with the trigger link and the second jaw component; and connecting the trigger link with the pair of triggers. This exemplary embodiment or another exemplary embodiment may further include steps of engaging a wrist strap assembly to a main body of the archery release; installing a wrist strap of the wrist strap assembly with a wrist; and pulling the wrist strap assembly simultaneously with the pair of triggers. This exemplary embodiment or another exemplary embodiment may further include a step of gripping a peg of a main body of the archery release with a third digit.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
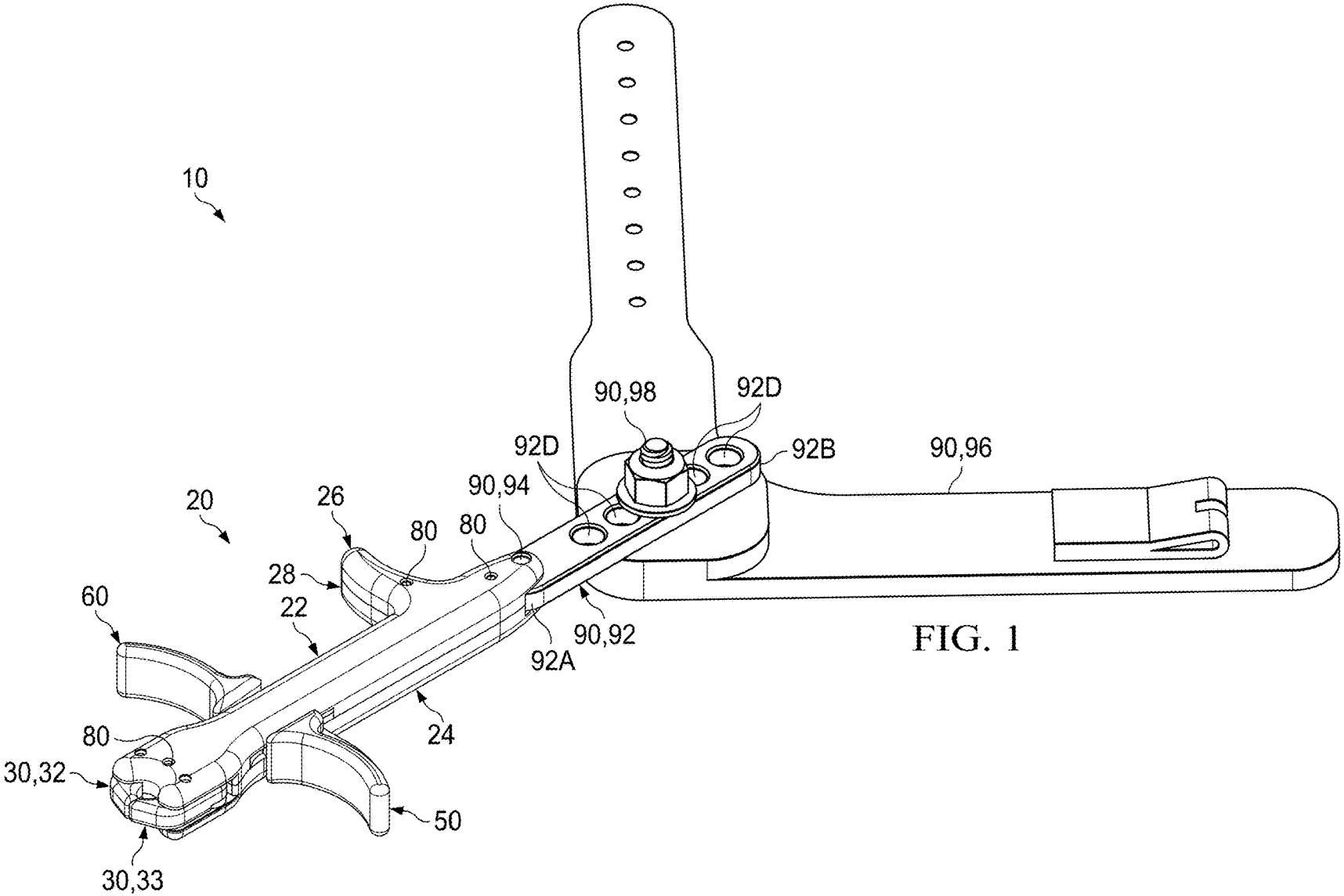
FIG. 1 (FIG. 1) is a front, bottom, left isometric perspective view of an archery release in accordance with one aspect of the present disclosure.
Figure 2:
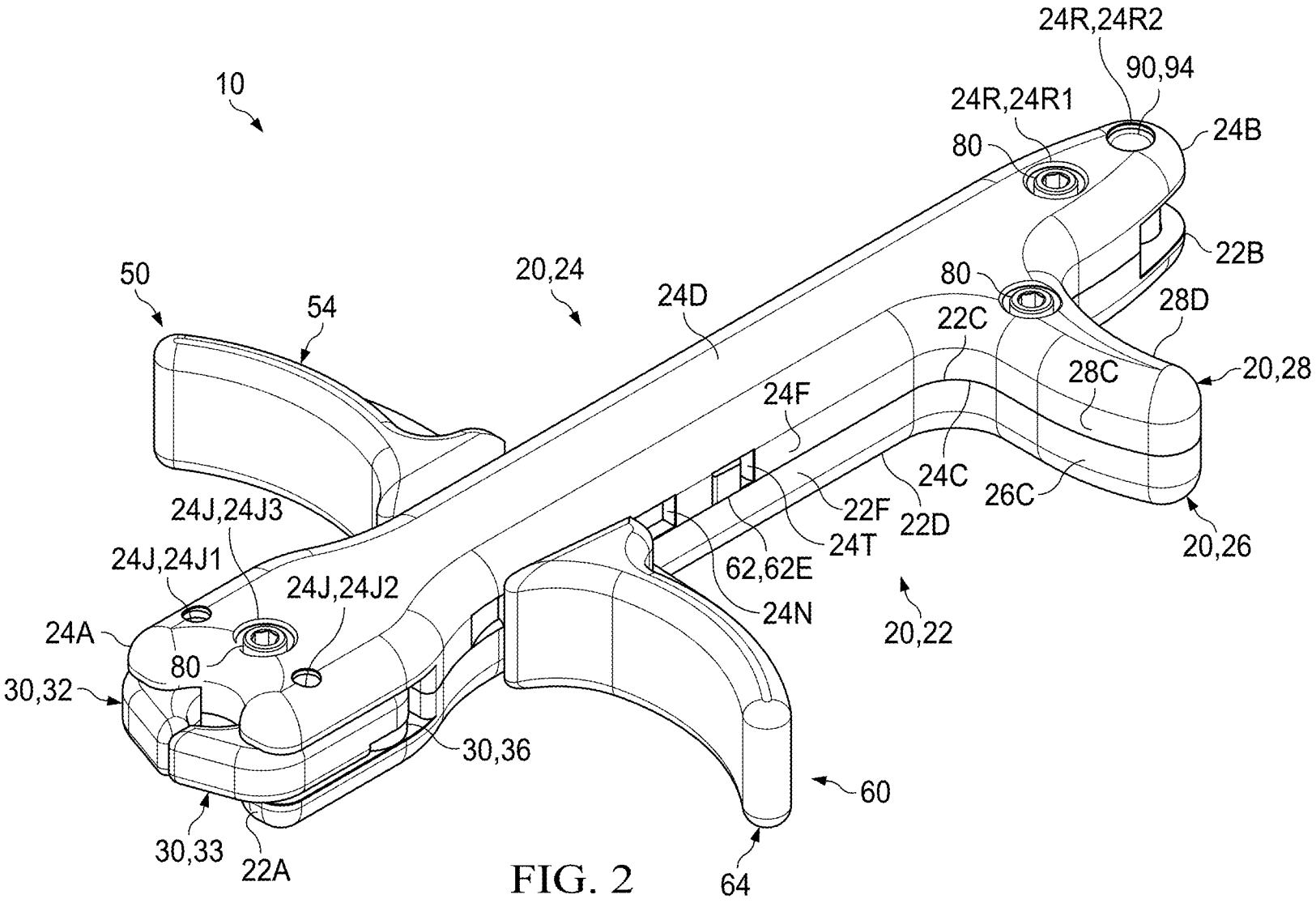
FIG. 2 (FIG. 2) is a front, bottom, left isometric perspective view of the archery release shown in FIG. 1, wherein a wrist strap assembly is removed from the archery release.

FIGS. 1-9D illustrate an archery release generally referred to as reference numeral 10. In the present disclosure, archery release 10 is configured with a dual trigger system that enables an archer to balance a draw force on a bowstring of a bow, preferably a compound bow, as the archer shoots or "pulls through the shot". The dual trigger system of archery release 10 also prevents inadvertent or unwanted movement of a nock point on the bowstring thus increasing accuracy when firing a bolt or arrow from the compound bow. Archery release 10 also includes a safety mechanism that prevents inadvertent or unwanted release of the bowstring as the archer draws the bowstring and bolt from a loading position to a firing position. The assemblies and components of archery release 10 are now discussed in greater detail below.

Archery release 10 includes a main body 20 that is formed by a first housing 22 and a second housing 24. When drawing the bow, the archer is enabled to grasp the first housing 22 and the second housing 24 as the archer collectively draws the archery release 10 and a bowstring of a bow for firing an arrow. In the present disclosure, the first housing 22 and the second housing 24 are operably engaged with one another to support and encase moving parts and components of archery release 10, which are described in greater detail below. It should be understood that the first housing 22 and the second housing 24 are substantially similar to one another and include substantially similar features and characteristics that mirror one another when assembled together to form main body 20.

Figure 5A:
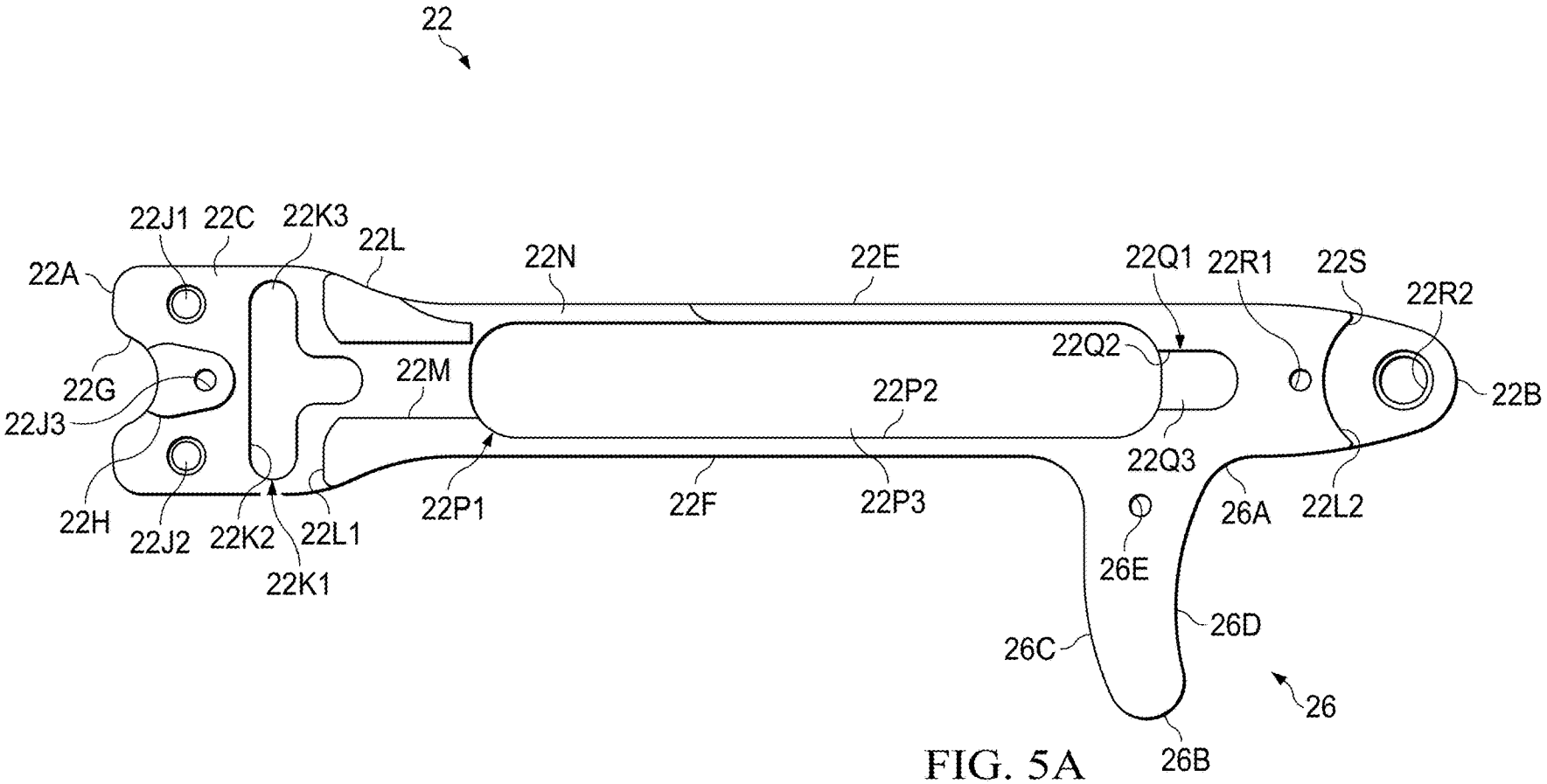
FIG. 5A (FIG. 5A) is a side elevation view of a first housing of the main body of the archery release.

With respect to first housing 22, first housing 22 includes a front end 22A, a rear end 22B longitudinally opposite to the front end 22A, and a longitudinal axis defined therebetween (see FIG. 5A). First housing 22 also includes a first or inner side 22C that extends between the front end 22A and the rear end 22B, a second or outer side 22D that extends between the front end 22A and the rear end 22B and is transversely opposite to the first side 22C, and a transverse axis defined therebetween (see FIG. 5A). First housing 22 also includes a top end 22E that is positioned vertically above the front end 22A, the rear end 22B, a first side 22C, and a second side 22D, a bottom end 22F that is positioned vertically below the front end 22A, the rear end 22B, a first side 22C, and a second side 22D, and a vertical axis defined therebetween (see FIG. 5A).

First housing 22 may include a notch 22G that extends rearward from the front end 22A towards the rear end 22B (see FIG. 5A). During use, the notch 22G allows a bowstring to pass through the first housing 22 when the archer loads the D-loop with the main body 20. First housing 22 also includes a stop 22H that extends outwardly from the inner side 10C and defines the notch 22G (see FIG. 5A). During use, the stop 22H may prevent a bowstring and/or a D-loop of a bowstring from traveling rearward once loaded into the archery release 10.

First housing 22 also defines a set of front countersunk openings 22J near the front end 22A of the first housing 22. As best seen in FIG. 5A, first housing 22 defines a first countersunk opening 22J1 of the set of front countersunk openings 22J that extends entirely through the first housing 22 from the inner side 22C to the outer side 22D such that the inner side 22C to the outer side 22D are in fluid communication with one another at the first countersunk opening 22J1. First housing 22 also defines a second countersunk opening 22J2 of the set of front countersunk openings 22J that extends entirely through the first housing 22 from the inner side 22C to the outer side 22D such that the inner side 22C to the outer side 22D are in fluid communication with one another at the second countersunk opening 22J2. In the present disclosure, the second countersunk opening 22J2 is defined vertically below the first countersunk opening 22J1. First housing 22 also defines a third countersunk opening 22J3 of the set of front countersunk openings 22J that extends entirely through the first housing 22 from the inner side 22C to the outer side 22D such that the inner side 22C to the outer side 22D are in fluid communication with one another at the third countersunk opening 22J3. In the present disclosure, the third countersunk opening 22J3 is defined between below the first countersunk opening 22J1 and the second countersunk opening 22J2.

First housing 22 also defines a first or T-shaped recess 22K1. As best seen in FIG. 5A, first recess 22K1 extends downwardly into the first housing 22 from the inner side 22C, extends along a first interior wall 22K2 of the first housing 22, and terminates at a first base wall 22K3. As such, the first interior wall 22K2 and the first base wall 22K3 collectively define the first recess 22K1. Such use of the first recess 22K1 is discussed in greater detail below.

First housing 22 also includes a projection 22L that extends longitudinally between the front end 22A and the second end 22B. As best seen in FIG. 5A, projection 22L includes a first or front end 22L1 that is defined proximate to the front end 22A and adjacent to the first recess 22K1, and a second or rear end 22L2 that is defined proximate to the rear end 22B and longitudinally opposite to the front end 22L1. With respect to projection 22L, projection 22L defines an interior groove or track 22M that extends longitudinally from the front end 22L1 towards the rear end 22L2.

First housing 22 also defines an upper channel 22N. As best seen in FIG. 5A, upper channel 22N is defined in the top end 22E of first housing 22 and in a portion of projection 22L. In the present disclosure, upper channel 22N is defined longitudinally behind track 22M while being in fluid communication with the track 22M to enable a trigger component or actuating device of archery release 10 to move along and be guided by the first housing 22 inside of the track 22M and the upper channel 22N; such descriptions of trigger components are discussed in greater detail below.

First housing 22 also defines a second recess 22P1. As best seen in FIG. 5A, second recess 22P1 extends downwardly into the first housing 22 from the inner side 22C, extends along a second interior wall 22P2 of the first housing 22, and terminates at a second base wall 22P3 that is spaced apart from the inner side 22C. As such, the second interior wall 22P2 and the second base wall 22P3 collectively define the second recess 22P1. The second recess 22P1 is also defined longitudinally behind the track 22M while being in fluid communication with the track 22M. The second recess 22P1 is also defined vertically below the upper channel 22N while being in fluid communication with the upper channel 22N. Such use of the second recess 22P1 is discussed in greater detail below.

First housing 22 also defines a third recess 22Q1. As best seen in FIG. 5A, third recess 22Q1 extends downwardly into the first housing 22 from the inner side 22C, extends along a third interior wall 22Q2 of the first housing 22, and terminates at a third base wall 22Q3 that is spaced apart from the inner side 22C. As such, the third interior wall 22Q2 and the third base wall 22Q3 collectively define the third recess 22!1. The third recess 22Q1 is also defined longitudinally behind the second recess 22P1 while being in fluid communication with the second recess 22P1. Such use of the third recess 22Q1 is discussed in greater detail below.

First housing 22 also defines a set of rear countersunk openings 22R near the rear end 22B of the first housing 22. As best seen in FIG. 5A, first housing 22 defines a first countersunk opening 22R1 of the set of rear countersunk openings 22R that extends entirely through the first housing 22 from the inner side 22C to the outer side 22D such that the inner side 22C to the outer side 22D are in fluid communication with one another at the first countersunk opening 22R1. First housing 22 also defines a second countersunk opening 22R2 of the set of rear countersunk openings 22R that extends entirely through the first housing 22 from the inner side 22C to the outer side 22D such that the inner side 22C to the outer side 22D are in fluid communication with one another at the second countersunk opening 22J2. In the present disclosure, the second countersunk opening 22R2 is defined at the rear end 22B of the first housing 22 and is defined longitudinally behind the first countersunk opening 22R1.

First housing 22 also includes a rear interior wall 22S positioned proximate to the rear end 22B. As best seen in FIG. 5A, rear interior wall 22S extends forwardly from the rear end 22B towards the front end 22A and defines a curvilinear and/or rounded shape. During use, the rear interior wall 22S enables an adapter plate of a wrist strap assembly of archery release 10 to ride along the rear interior wall 22S as the adapter plate pivots with the main body 20; such wrist strap assembly of archery release 10 is discussed in greater detail below.

As discussed previously, the second housing 24 is substantially similar to first housing 22 such that the first housing 22 and the second housing 24 are mirror-imaged parts of main body 20. Particularly, elements and features of the second housing 24 are substantially similar to first housing 22 in which the elements and features of the second housing 24 are mirrored to the elements and features of the first housing 22 (see FIG. 5B). As such, and as best seen in FIG. 5B, second housing 24 includes a front end 24A, a second end 24B, a first or inner side 24C, a second or outer side 24D, a top end 24E, a bottom end 24F, a notch 24G, a stop 24H, a set of front countersunk openings 24J1, 24J2, 24J3, a first recess 24K1 collectively defined by a first interior wall 24K2 and a first base wall 24K3, a projection 24L having first and second ends 24L1, 24L2, an interior groove or track 24M, a lower channel 24N, a second recess 24P1 collectively defined by a second interior wall 24P2 and a second base wall 24P3, a third recess 24Q1 collectively defined by a third interior wall 24Q2 and a third base wall 24Q3, a set of rear countersunk openings 24R1, 24R2, and a rear interior wall 24S that are substantially similar to the front end 22A, the second end 22B, the inner side 22C, the outer side 22D, the top end 22E, the bottom end 22F, the notch 22G, the stop 22H, set of front countersunk openings 22J1, 22J2, 22J3, first recess 22K1 collectively defined by the first interior wall 22K2 and the first base wall 22K3, the projection 22L, the interior groove or track 22M, the upper channel 22N, second recess 22P1 collectively defined by the second interior wall 22P2 and the second base wall 22P3, the third recess 22Q1 collectively defined by the third interior wall 22Q2 and the third base wall 22Q3, the set of rear countersunk openings 22R1, 22R2, and the rear interior wall 22S.

With respect to the second housing 24, second housing 24 does include and/or define different elements and/or features than the first housing 22. As best seen in FIG. 5B, second housing 24 defines a safety aperture 24T that extends upwardly into the second housing 24 from the bottom end 24F, through projection 24L, and into the second recess 24P1. In the present disclosure, the safety aperture 24T is defined longitudinally behind the lower channel 24N and vertically below the second recess 24P1. Such use and purpose of safety aperture 24T is discussed in greater detail below.

Main body 20 also includes a pair of grips or pegs 26, 28 arranged in a mirrored orientation when the first housing 22 and the second housing 24 are assembled with one another. With respect to first housing 22, and as best seen in FIG. 5A, first housing 22 includes first peg 26 that extends downwardly from the bottom end 22F of first housing 22. In the present disclosure, first peg 26 includes a top end 26A that operably engages with the bottom end 22F of the first housing 22, a bottom end 26B that is spaced apart from the bottom end 22F and opposite to the top end 26A, and an axis defined therebetween. First peg 26 also defines a first or front grip surface 26C that extends between the top end 26A and the bottom end 26B and faces towards the front end 22A. First peg 26 also defines a second or rear grip surface 26D that extends between the top end 26A and the bottom end 26B and faces towards the rear end 22B opposite to the front grip surface 26C. In the present disclosure, the front grip surface 26C defines a convex shape when viewed from a side elevation view (see FIG. 5A), and the rear grip surface 26D defines a concave shape when viewed from a side elevation view (see FIG. 5A). First peg 26 also defines a countersunk opening 26E that extends entirely through the first peg 26 along an axis that is orthogonal to the axis extending between the top end 26A and the bottom end 26B; such use of countersunk opening 26E is discussed in greater detail below.

Figure 5B:
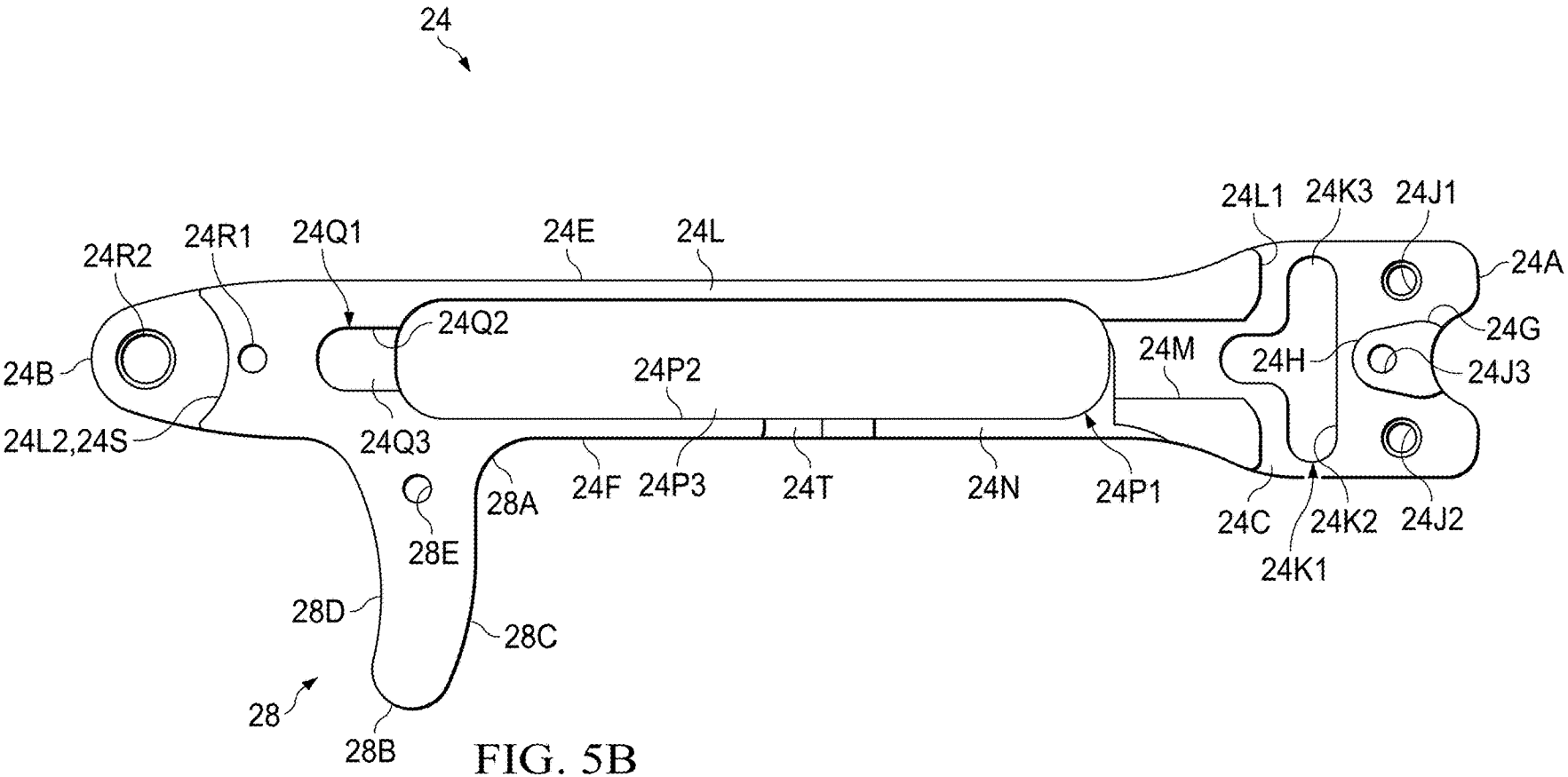
FIG. 5B (FIG. 5B) is a side elevation view of a second housing of the main body of the archery release.
Figure 6:
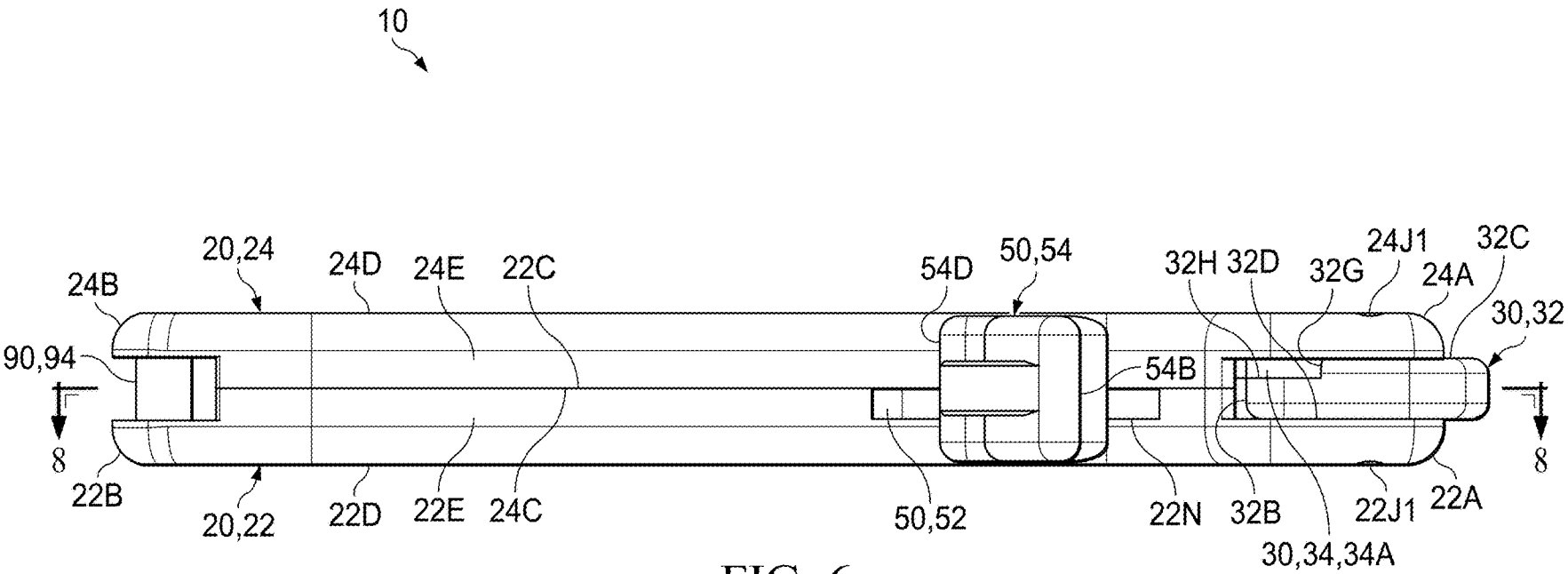
FIG. 6 (FIG. 6) is a top plan view of the archery release.
Figure 7:
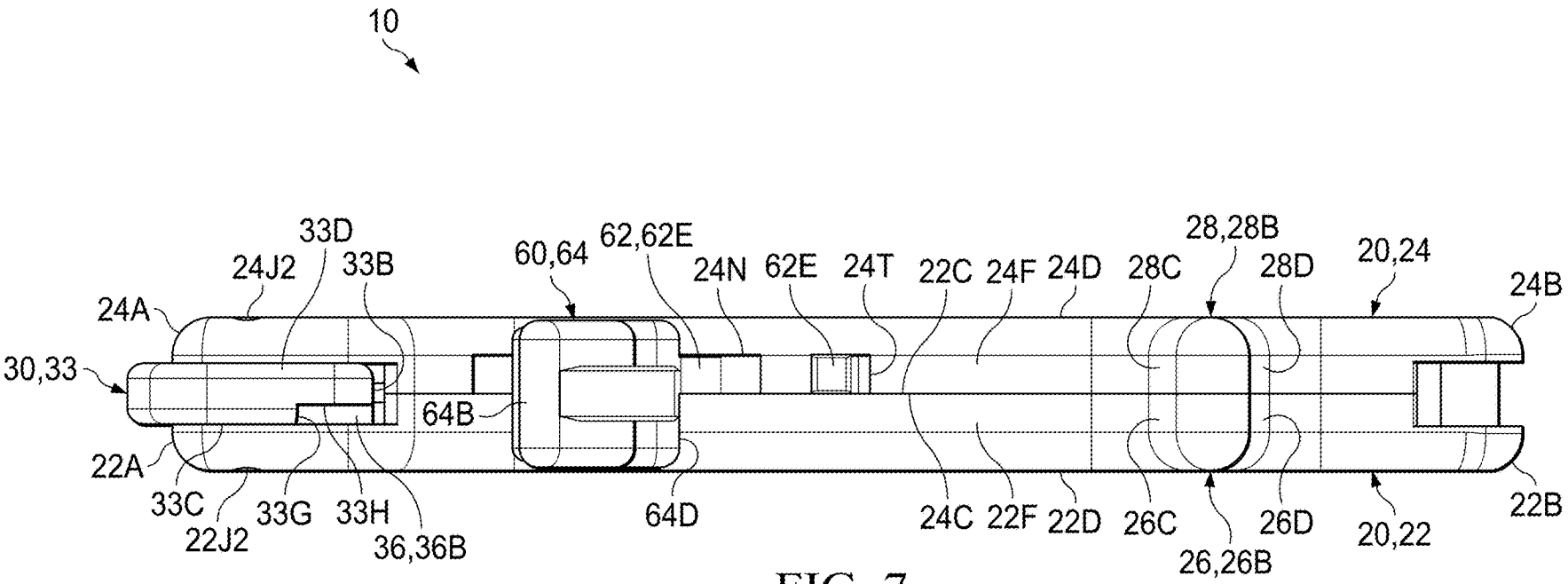
FIG. 7 (FIG. 7) is a bottom plan view of the archery release.

With respect to second housing 24, and as best seen in FIG. 5B, second housing 24 includes second peg 28 that extends downwardly from the bottom end 24E of second housing 24. In the present disclosure, second peg 28 includes a top end 28A that operably engages with the bottom end 24E of the second housing 24, a bottom end 28B that is spaced apart from the bottom end 24E and opposite to the top end 28A, and an axis defined therebetween. Second peg 28 also defines a first or front grip surface 28C that extends between the top end 28A and the bottom end 28B and faces towards the front end 24A. Second peg 28 also defines a second or rear grip surface 28D that extends between the top end 28A and the bottom end 28B and faces towards the rear end 24B opposite to the front grip surface 28C. In the present disclosure, the front grip surface 28C defines a convex shape when viewed from a side elevation view (see FIG. 5B), and the rear grip surface 28D defines a concave shape when viewed from a side elevation view (see FIG. 5B). Second peg 28 also defines a countersunk opening 28E that extends entirely through the second peg 28 along an axis that is orthogonal to the axis extending between the top end 28A and the bottom end 28B; such use of countersunk opening 28E is discussed in greater detail below.

Archery release 10 also includes a jaw assembly 30 that operably engages with the main body 20. In operation, the jaw assembly 30 is configured to hold and release a D-loop of a bowstring of a bow for firing an arrow or bolt down range. Such components and elements of jaw assembly 30 are discussed in greater detail below.

Figure 3:
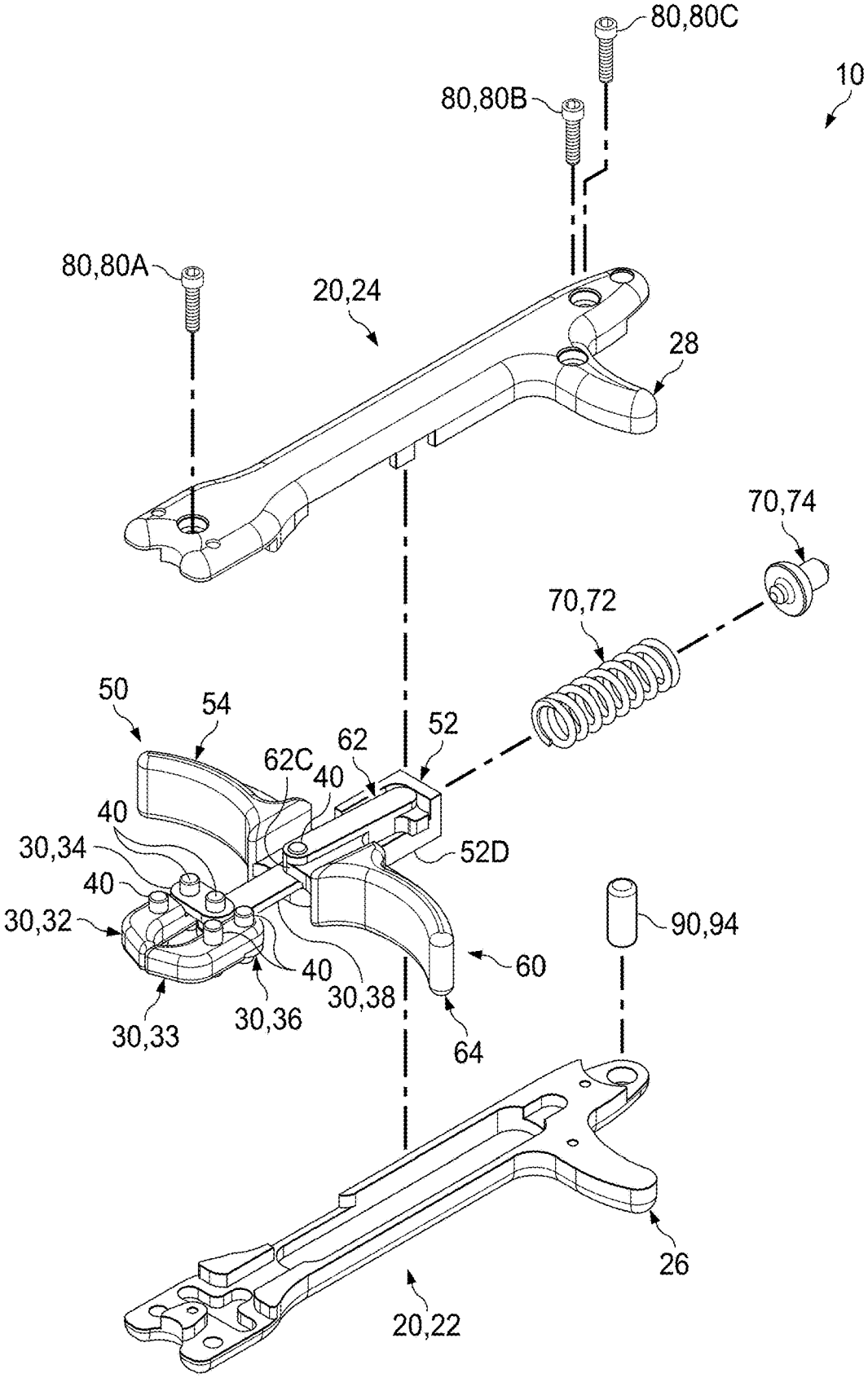
FIG. 3 (FIG. 3) is an exploded view of a main body of the archery release and a release assembly of the archery release.
Figure 3A:
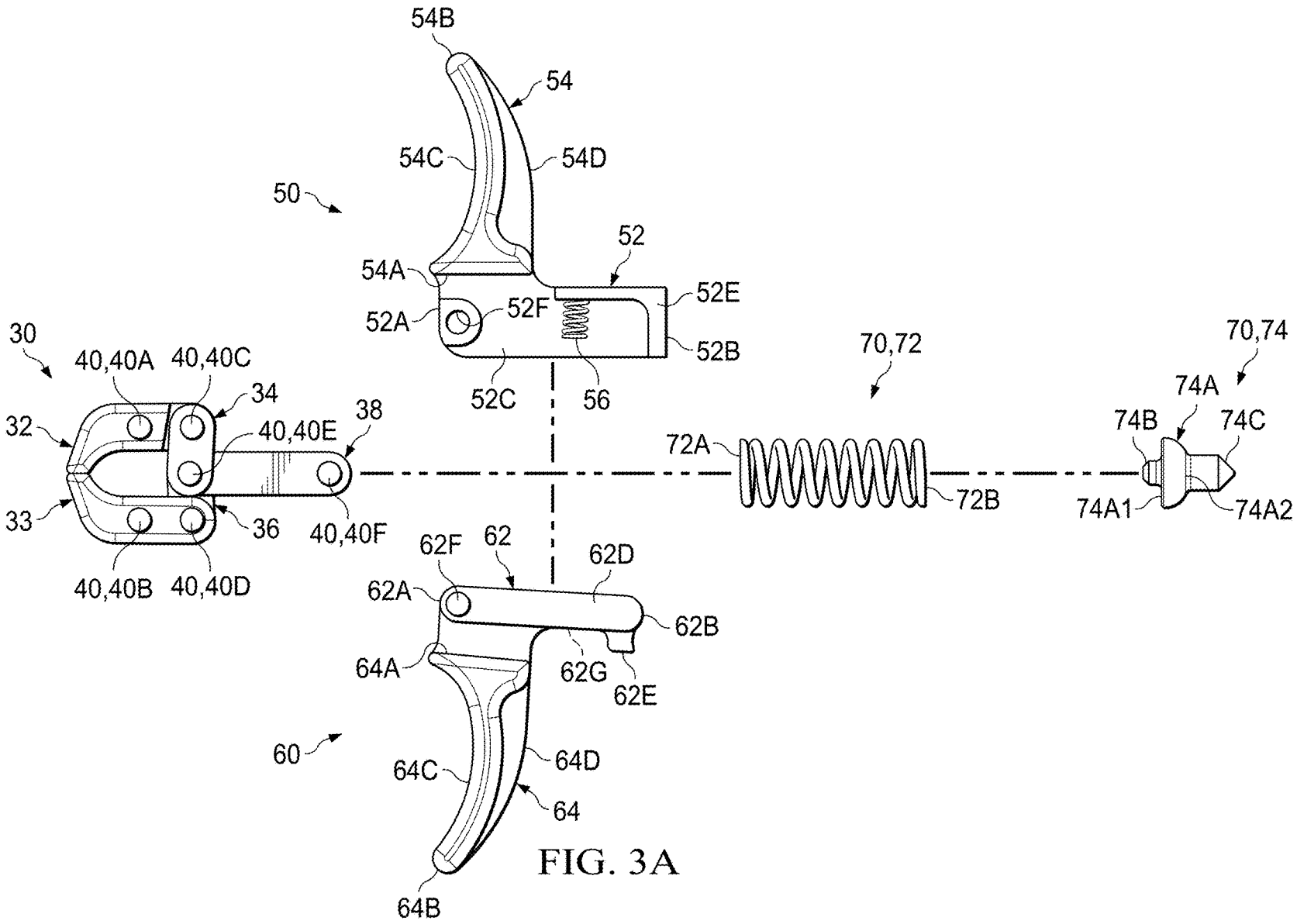
FIG. 3A (FIG. 3A) is an exploded view of a jaw assembly of the release assembly of the archery release, a pair of trigger components of release assembly of the archery release, and a biasing assembly of the archery release of the archery release.
Figure 3B:
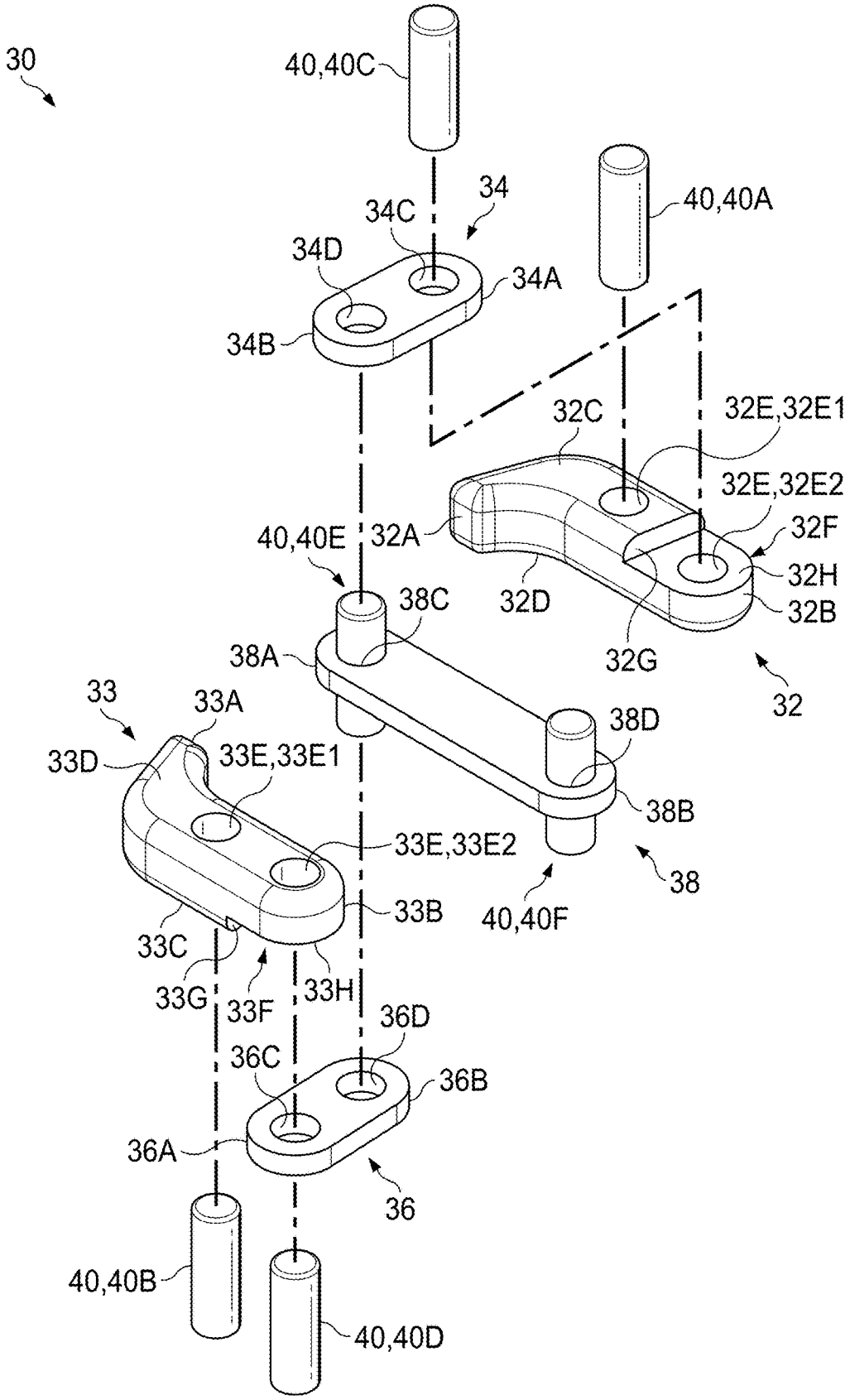
FIG. 3B (FIG. 3B) is an exploded view of the jaw assembly of the release assembly of the archery release.
Figure 4:
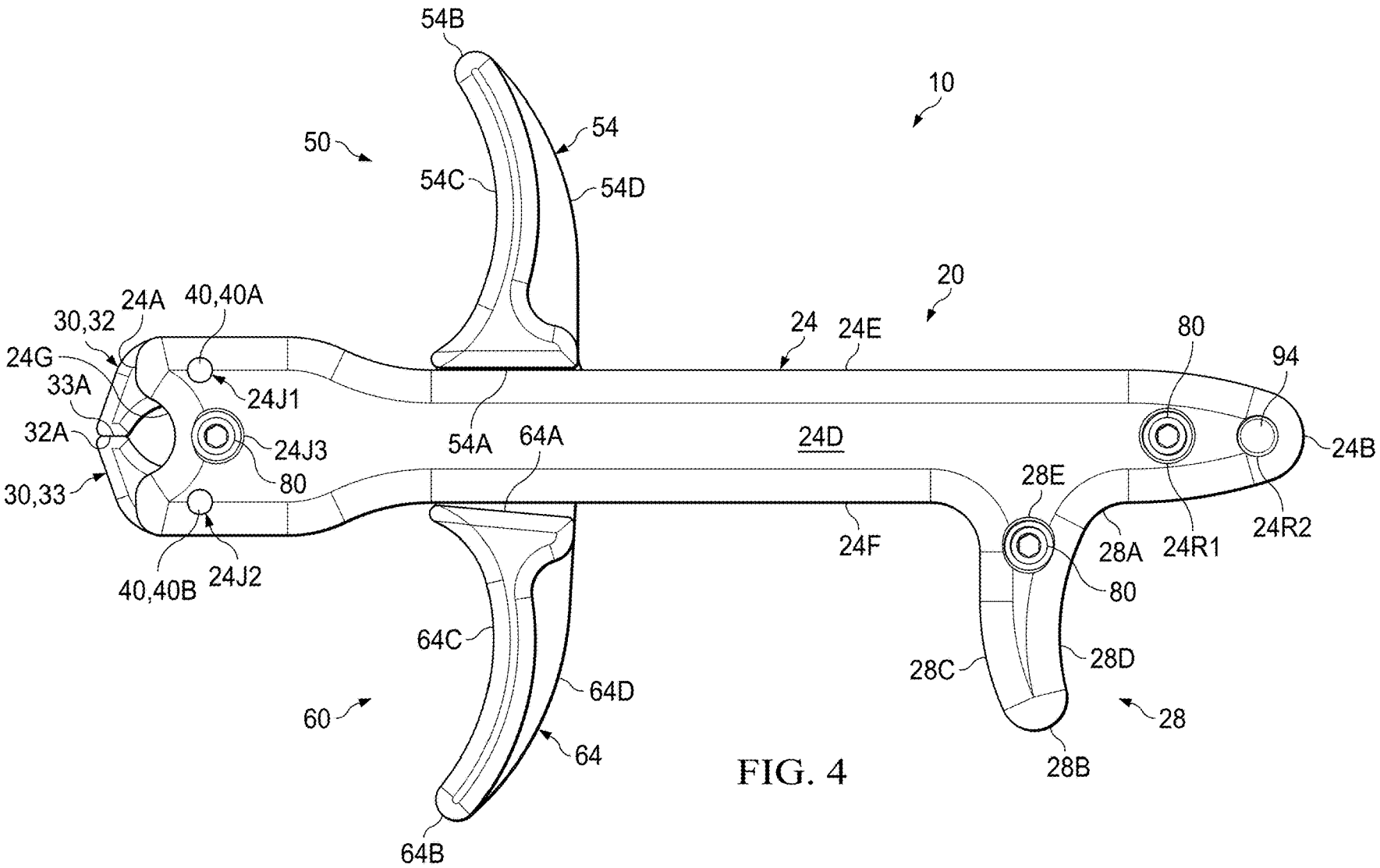
FIG. 4 (FIG. 4) is side elevation view of the archery release.

Jaw assembly 30 includes a pair of jaws 32, 33. As best seen in FIGS. 3-3B, jaw assembly includes a first jaw 32 and a second jaw 33 that are spaced apart from one another and directly oppose one another to create a jaw or clamp mechanism. With respect to first jaw 32, first jaw 32 includes a tip 32A, a base 32B that spaced apart from and opposite to tip 32A, and a lengthwise axis defined therebetween (see FIG. 3B). As best seen in FIG. 3B, first jaw 32 also includes an inner surface 32C that extends longitudinally between the tip 32A and the base 32B and faces inwardly at the second housing 24 when archery release 10 is assembled. Still referring to FIG. 3B, first jaw 32 also includes an outer surface 32D that extends longitudinally between the tip 32A and the base 32B and faces outwardly at the first housing 22 when archery release 10 is assembled. In the present disclosure, the inner surface 32C and the outer surface 32D face in opposite direction from one another.

First jaw 32 also defines a pair of openings 32E that extends entirely through the first jaw 32 along an axis that is orthogonal to the lengthwise axis of first jaw 32. As best seen in FIG. 3B, a first opening 32E1 of the pair of openings 32E is defined between the tip 32A and the base 32B. Still referring to FIG. 3A, a second opening 32E2 of the pair of openings 32E is defined between the first opening 32E1 and the base 32B and is defined proximate to the base 32B. Such use and purpose of the pair of openings 32E is discussed in greater detail below.

First jaw 32 also defines a recess 32F. As best seen in FIG. 3B, the recess 32F extends downwardly into the first jaw 32 from the inner surface 32C, extends along an inner upright wall 32G, and terminates at an inner horizontal wall 32H. In the present disclosure, the inner upright wall 32G and the inner horizontal wall 32H collectively define recess 32F. The use and purpose of recess 32F defined in first jaw 32 is discussed in greater detail below.

With respect to second jaw 33, second jaw 33 includes a tip 33A, a base 33B that spaced apart from and opposite to tip 33A, and a lengthwise axis defined therebetween (see FIG. 3B). As best seen in FIG. 3B, second jaw 33 also includes an inner surface 33C that extends longitudinally between the tip 33A and the base 33B and faces inwardly at the first housing 22 when archery release 10 is assembled. Still referring to FIG. 3B, second jaw 33 also includes an outer surface 33D that extends longitudinally between the tip 33A and the base 33B and faces outwardly at the second housing 23 when the archery release 10 is assembled. In the present disclosure, the inner surface 33C and the outer surface 33D face in opposite direction from one another.

Second jaw 33 also defines a pair of openings 33E that extends entirely through the second jaw 33 along an axis that is orthogonal to the lengthwise axis of second jaw 33. As best seen in FIG. 3B, a first opening 33E1 of the pair of openings 33E is defined between the tip 33A and the base 33B. Still referring to FIG. 3B, a second opening 33E2 of the pair of openings 33E is defined between the first opening 33E1 and the base 33B and is defined proximate to the base 33B. Such use and purpose of the pair of openings 33E is discussed in greater detail below.

Second jaw 33 also defines a recess 33F. As best seen in FIG. 3B, the recess 33F extends downwardly into the second jaw 33 from the inner surface 33C, extends along an inner upright wall 33G, and terminates at an inner horizontal wall 33H. In the present disclosure, the inner upright wall 33G and the inner horizontal wall 33H collectively define recess 33F. The use and purpose of recess 33F defined in second jaw 33 is discussed in greater detail below.

Jaw assembly 30 also includes a first cam link 34 that operably engages with the first jaw 32. As best seen in FIG. 3B, first cam link 34 includes a first or outer end 34A, a second or inner end 34B opposite to the first end 34A, and a lengthwise axis defined therebetween. First cam link 34 also defines a first opening 34C at the first end 34A. The first opening 34C also extends entirely through the first cam link 34 along an axis that is orthogonal to the lengthwise axis of the first cam link 34. First cam link 34 also defines a second opening 34D at the second end 34B. The second opening 34D also extends entirely through the first cam link 34 along an axis that is orthogonal to the lengthwise axis of the first cam link 34.

Jaw assembly 30 also includes a second cam link 36 that operably engages with the second jaw 33. As best seen in FIG. 3B, second cam link 36 includes a first or outer end 36A, a second or inner end 36B opposite to the first end 36A, and a lengthwise axis defined therebetween. Second cam link 36 also defines a first opening 36C at the first end 36A. The first opening 36C also extends entirely through the second cam link 36 along an axis that is orthogonal to the lengthwise axis of the second cam link 36. Second cam link 36 also defines a second opening 36D at the second end 36B. The second opening 36D also extends entirely through the second cam link 36 along an axis that is orthogonal to the lengthwise axis of the second cam link 36.

Jaw assembly 30 also includes a trigger link 38 that operably engages with the first cam link 34 and the second cam link 36. As best seen in FIG. 9, trigger link 38 includes a first or front end 38A, a second or rear end 38B opposite to the first end 38A, and a lengthwise axis defined therebetween. Trigger link 38 also defines a first opening 38C at the first end 38A. The first opening 38C also extends entirely through the trigger link 38 along an axis that is orthogonal to the lengthwise axis of the trigger link 38. Trigger link 38 also defines a second opening 38D at the second end 38B. The second opening 38D also extends entirely through the trigger link 38 along an axis that is orthogonal to the lengthwise axis of the trigger link 38.

Figure 8:
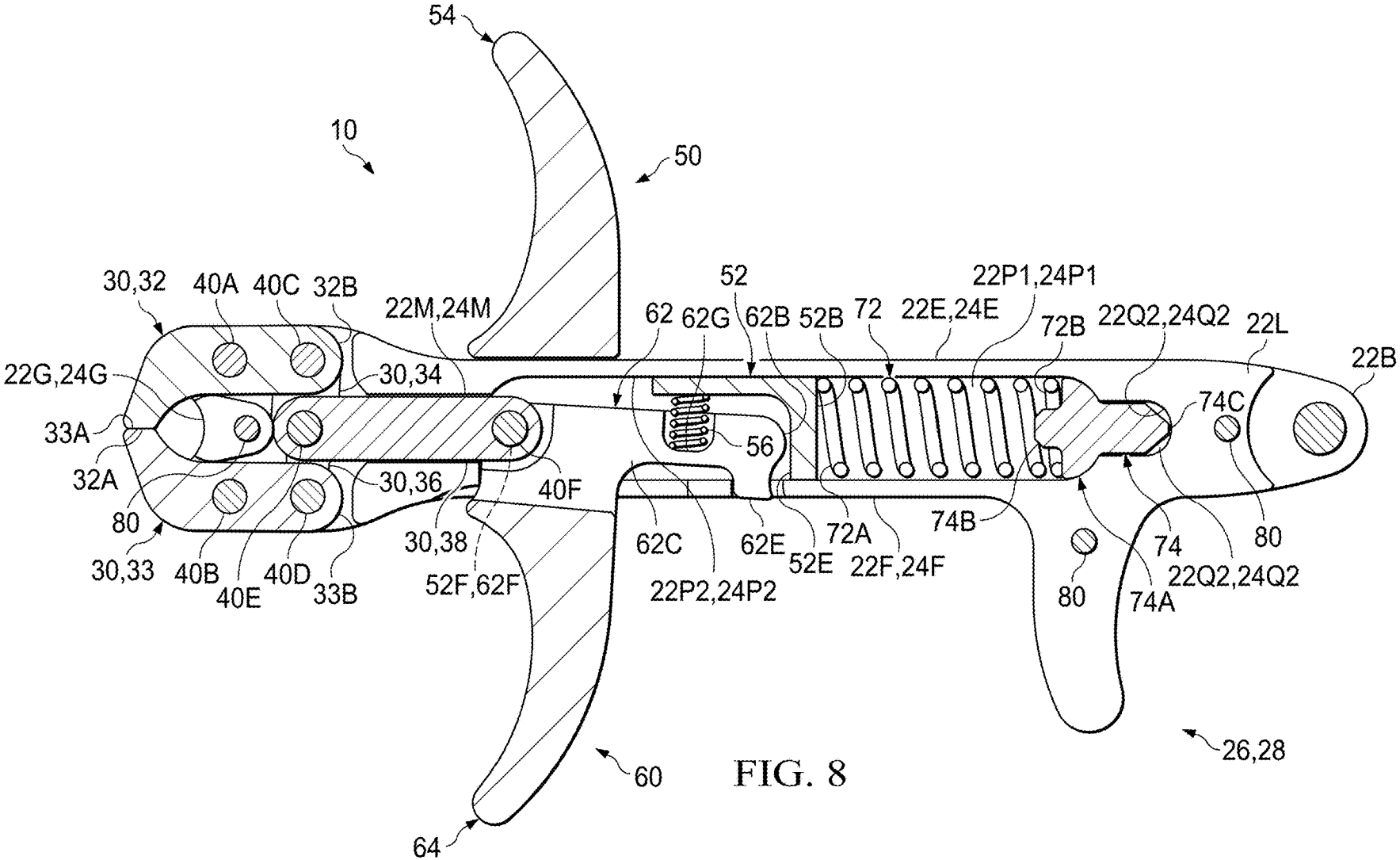
FIG. 8 (FIG. 8) is a longitudinal section view of the archery release taken in the direction of line 8-8 shown in FIG. 6.

Jaw assembly 30 also includes a set of dowels or attachment members 40 that operably engages and/or links the main body 20, the pair of jaws 32, the first cam link 34, the second cam link 36, and the trigger link 38 with one another. As best seen in FIGS. 3A-3B and 8, a first dowel 40A of the set of dowels 40 operably engages the main body 20 and the first jaw 32 with one another. Particularly, the first dowel 40A operably engages with the first housing 22 and the second housing 24 at the first countersunk openings 22J1, 24J1 and with the first jaw 32 at the first opening 33E1. Still referring to FIGS. 3A-3B and 8, a second dowel 40B of the set of dowels 40 operably engages the main body 20 and the second jaw 33 with one another. Particularly, the second dowel 40B operably engages with the first housing 22 and the second housing 24 at the second countersunk openings 22J2, 24J2 and with the second jaw 33 at the first opening 33E1.

Still referring to FIGS. 3A-3B and 8, a third dowel 40C of the set of dowels 40 operably engages the first jaw 32 and the first cam link 34 with one another. Particularly, the third dowel 40C operably engages with the first jaw 32 at the second opening 33E2 and with the first cam link 34 at the first opening 34C. Still referring to FIGS. 3A-3B and 8, a fourth dowel 40D of the set of dowels 40 operably engages the second jaw 33 and the second cam link 36 with one another. Particularly, the fourth dowel 40D operably engages with the second jaw 33 at the second opening 33E2 and with the second cam link 36 at the first opening 36C. Still referring to FIGS. 3A-3B and 8, a fifth dowel 40E of the set of dowels 40 operably engages the first cam link 34, the second cam link 36, and the trigger link 38 with one another. Particularly, the fifth dowel 40E operably engages with the first cam link 34 at the second opening 34D, with the second cam link 36 at the second opening 36D, and with the trigger link 38 at the first opening 38C.

Archery release 10 also includes a first trigger component 50 that operably engaged with the jaw assembly 30 and housed inside of the main body 20. First trigger component 50 includes a base member 52 that operably engages with the jaw assembly 30, particularly the trigger link 38. As best seen in FIG. 3A, base member 52 includes a front end 52A, a rear end 52B longitudinally opposite to the front end 52A, and a lengthwise axis defined therebetween. Base member 52 also includes an inner surface 52C that extends longitudinally between the front end 52A and the rear end 52B and faces away from the first housing 22 when the archery release 10 is assembled. Base member 52 also includes an outer surface 52D that extends longitudinally between the front end 52A and the rear end 52B and towards the first housing 22 when the archery release 10 is assembled; the outer surface 52D faces away from the inner surface 52C in an opposite direction. Base member 52 also includes an engagement member or extension 52E that extends outwardly from the inner surface 52C along an axis that is orthogonal to the lengthwise axis of base member 52; such use of engagement member 52E is discussed in greater detail below.

Base member 52 also defines a linkage opening 52F at the front end 52A. The linkage opening 52F also extends entirely through the base member 52 along an axis that is orthogonal to the lengthwise axis extending between the front end 52A and the rear end 52B. In the present disclosure, a sixth dowel 40F of the set of dowels 40 operably engages the trigger link 38 and the base member 52 with one another. Particularly, the sixth dowel 40F operably engages with the trigger link 38 at the second opening 38D and with the base member 52 at the linkage opening 52F. Such engagement between the trigger link 38 and the base member 52, by the sixth dowel 40F, enables the first trigger component 50 to longitudinally move the jaw assembly 30 between the closed position (see FIG. 9A) to the open position (see FIG. 9D); such movement of the jaw assembly 30 during an archery operation is discussed in greater detail below.

First trigger component 50 also includes a trigger 54 that extends upwardly from the base member 52. As best seen in FIG. 3A, trigger 54 includes a top end 54A, a bottom end 54B that is opposite to the top end 54A and operably engages with the base member 52, and an axis defined therebetween. Trigger 54 also defines a first or front grip surface 54C that extends between the top end 54A and the bottom end 54B and faces towards the front end 22A of first housing 22 when archery release 10 is assembled. Trigger 54 also defines a second or rear grip surface 54D that extends between the top end 54A and the bottom end 54B and faces in an opposing direction relative to the front grip surface 54C. In the present disclosure, the front grip surface 54C defines a concave shape when viewed from a side elevation view (see FIG. 3A), and the rear grip surface 54D defines a convex shape when viewed from a side elevation view (see FIG. 3A).

Archery release 10 also includes a second trigger component 60 that operably engaged with the jaw assembly 30 and housed inside of the main body 20. Second trigger component 60 includes a base member 62 that operably engages with the jaw assembly 30, particularly the trigger link 38. As best seen in FIG. 3A, base member 62 includes a front end 62A, a rear end 62B longitudinally opposite to the front end 62A, and a lengthwise axis defined therebetween. Base member 62 also includes an inner surface 62C that extends longitudinally between the front end 62A and the rear end 62B and faces away from the second housing 24 when archery release 10 is assembled. Base member 62 also includes an outer surface 62D that extends longitudinally between the front end 62A and the rear end 62B and faces towards the second housing 24 when archery release 10 is assembled; the outer surface 62D faces away from the inner surface 62C in an opposite direction.

As compared to base member 52 of first trigger component 50, base member 62 includes a safety member or extension 62E that extends outwardly from the base member 62 at the rear end 62B along an axis that is orthogonal to the lengthwise axis of base member 62. Upon assembly of archery release 10, safety member 62E is configured to operably engaged with the second housing 24 inside of the safety aperture 24T to prevent longitudinal movement of the first trigger component 50 and the second trigger component 60 causing the jaw assembly 30 to move from the closed position to the open position; such safety mechanism provided by the second trigger component 60 is discussed in greater detail below.

Base member 62 also defines a linkage opening 62F at the front end 62A. The linkage opening 62F also extends entirely through the base member 62 along an axis that is orthogonal to the lengthwise axis extending between the front end 62A and the rear end 62B. In the present disclosure, sixth dowel 40F of the set of dowels 40 operably engages the trigger link 38 and the base member 62 with one another. Particularly, the sixth dowel 40F operably engages with the trigger link 38 at the second opening 38D and the base member 62 at the linkage opening 62F. Such engagement between the trigger link 38 and the base member 62, by the sixth dowel 40F, enables the second trigger component 60 to longitudinally move the jaw assembly 30 between the closed position (see FIG. 9A) to the open position (see FIG. 9B); such movement of the jaw assembly 30 during an archery operation is discussed in greater detail below. It should be understood that sixth dowel 40F also links the base member 52 of the first trigger component 50 and the base member 62 of the second trigger component 60 with one another to provide a dual trigger mechanism for archers handling and operating archery release 10.

Base member 62 also defines a retention cavity 62G that extends downwardly into the base member 62. In the present disclosure, retention cavity 62G is defined proximate to the rear end 62B and defined ahead of the safety member 62E. As best seen in FIGS. 3A and 8, the retention cavity 62G is configured to receive a biaser 56 that operably engages with the base member 52 of the first trigger component 50 (particularly engagement member 52E) and the base member 62 of the second trigger component 60. Upon assembly, a first end of the biaser 56 operably engages with the engagement member 52E of the base member 52, and a second opposing end of the biaser 56 is housed inside of the retention cavity 62G and operably engages with the base member 62 of the second trigger component 60. In operation, biaser 56 is configured to bias the base member 62 of second trigger component 60 downwardly so that the safety member 62E remains engaged with the second housing 24 inside of the safety aperture 24T. If desired, archer may apply a force greater than a biasing force of the biaser 56 to disengage the safety member 62E from the second housing 24 to remove the archery release 10 from the safety position; such actions by the archer on the archery release 10 are discussed in greater detail below.

Second trigger component 60 also includes a trigger 64 that extends upwardly from the base member 62. As best seen in FIG. 3A, trigger 64 includes a top end 64A, a bottom end 64B that is opposite to the top end 64A and operably engages with the base member 62, and an axis defined therebetween. Trigger 64 also defines a first or front grip surface 64C that extends between the top end 64A and the bottom end 64B and faces towards the front end 22A of first housing 22 when archery release 10 is assembled. Trigger 64 also defines a second or rear grip surface 64D that extends between the top end 64A and the bottom end 64B and faces in an opposite direction relative to the front grip surface 64C. In the present disclosure, the front grip surface 64C defines a concave shape when viewed from a side elevation view (see FIG. 3A), and the rear grip surface 64D defines a convex shape when viewed from a side elevation view (see FIG. 3A).

The dual trigger mechanism of the first trigger component 50 and the second trigger component 60 is considered advantageous at least because the dual trigger configuration allows an archer to apply a balanced or equal draw force on the first trigger component 50 and the second trigger component 60 as the archer pulls through an archery shot. Such balanced force applied on the first trigger component 50 and the second trigger component 60 prevents the archer from inadvertently or unwantedly moving a nock point of the bowstring which would negatively impact the accuracy of the bow. In this configuration, the first jaw 32 and the second jaw 33 may open in line with the nock point and the shaft of the arrow thus removing the concern of potential inaccuracy caused by moving said nock point. Such balanced force applied on the first trigger component 50 and the second trigger component 60 also allows for a heavier spring force or greater biasing force in order to move the jaw assembly 30 from the closed position (FIG. 9A) to the open position (FIG. 9D) for releasing a bowstring. The heavier spring force or greater biasing force may thus reduce or remove the inducement of unwanted movement of the nock point when firing the bow.

Archery release 10 also includes a biasing assembly 70 that operably engages with the main body 20 and the first trigger component 50. As best seen in FIG. 3A, biasing assembly 70 includes a main biaser 72 that has a first or front end 72A that operably engages with the rear end 52B of base member 52, a second or rear end 72B opposite to the front end 72A, and a longitudinal axis defined therebetween. In operation, main biaser 72 is configured to bias the first trigger component 50 and the second trigger component 60 towards the front ends 22A, 24A of the first and second housings 22, 24 to maintain first trigger component 50 and the second trigger component 60 at the safety position and the jaw assembly 30 at the closed position.

Biasing assembly 70 also includes a biaser plate 74 that operably engages with the main body 20 and the rear end 70B of main biaser 72. As best seen in FIG. 3A, biaser plate 74 includes a stop portion 74A that operably engages with the rear end 70B of main biaser 72 at a front end 74A1 of stop portion 74A. In the present disclosure, stop portion 74A is also configured to operably engage with and be housed inside of the first housing 22 and the second housing 24 of main body 20. As best seen in FIGS. 8-9, a rear end 74A2 of stop portion 74A operably engages with the second interior walls 22P2, 24P2 and the second base walls 22P3, 24P3 of the first and second housings 22, 24 inside of the second recesses 22P1, 24P1 of the first and second housings 22, 24.

Biaser plate 74 also includes an alignment pin or portion 74B. As best seen in FIG. 3A, alignment pin 74B extends outwardly from the front end 74A1 of stop portion 74A. Upon assembly, alignment pin 74B is configured to maintain the axial position of the main biaser 72 to prevent the rear end 72B of the main biaser 72 from shifting and/or moving when the main biaser 72 is compressed by the first trigger component 50 and the second trigger component 60.

Biaser plate 74 also includes a retaining pin 74C. As best seen in FIG. 3A, retaining pin 74C extends outwardly from the rear end 74A2 of stop portion 74A. Upon assembly, retaining pin 74C is configured to operably engage with and be housed inside of the first housing 22 and the second housing 24. As best seen in FIGS. 8-9, the retaining pin 74C operably engages with the third interior walls 22Q2, 24Q2 and the third base walls 22Q3, 24Q3 of the first and second housings 22, 24 inside of the third recesses 22Q1, 24Q1 of the first and second housings 22, 24.

In the present disclosure, main biaser 72 is a compression spring that exerts an outward force on the first trigger component 50 (particularly at the rear end 52B of the base member 52) and the biaser plate 74 to bias the first trigger component 50 and the second trigger component 60 to the first position and to maintain the jaw assembly 30 at the closed position. It should be appreciated that any suitable biaser may be used for main biaser 72 may be used for biasing the first trigger component 50 and the second trigger component 60 to the first position to maintain the jaw assembly 30 at the closed position. Examples of suitable biasers for biasing a first trigger component and a second trigger component to a first position to maintain a jaw assembly at a closed position include an extension spring, a torsion spring, a laminated or leaf spring, disc or Belleville spring, and other suitable types of biasers of the like.

It should also be understood that main biaser 72 may have any suitable compression and/or biasing force based on the size, shape, and configuration of main biaser 72. In one exemplary embodiment, main biaser 72 may have a static or defined biasing force that biases the first trigger component 50 and the second trigger component 60 to the first position. In another exemplary embodiment, main biaser 72 may have a dynamic or variable biasing force that biases the first trigger component 50 and the second trigger component 60 to the first position; as such, the archer may be able to vary or dynamically change the biasing force of the main biaser 72 with assistance of additional biasing components included with biasing assembly 70. In this exemplary embodiment, a set screw may be threadably engaged with a housing (e.g., first housing 22 or second housing 24) of main body 20 to contact the biaser plate 74 for adjustability purposes. Particularly, the set screw may push against the biaser plate 74 inside of main body 20 to move the biaser plate 74 in a forward direction towards the first ends 22A, 24A of the first and second housing 22, 24 to increase the biasing force of main biaser 72 on the first trigger component 50 if desired. It should also be noted that the set screw may be unscrewed from the biaser plate 74 inside of main body 20 to move the biaser plate 74 in a rearward direction towards the second ends 22B, 24B of the first and second housing 22, 24 to decrease the biasing force of main biaser 72 on the first trigger component 50 if desired.

Archery release 10 also includes a set of attachment components or fasteners 80. As best seen in FIG. 3, a first fastener 80A of the set of fasteners 80 operably engaged the first housing 22 and the second housing 24 with one another at the third countersunk openings 22J3, 24J3. In the present disclosure, the first and second housings 22, 24 include a threading (not shown) in the third countersunk openings 22J3, 24J3 to enable the first fastener 80A to threadably engage with the first and second housings 22, 24. Similarly, second and third fasteners 80B, 80C of the set of fasteners 80 operably engage the first housing 22 and the second housing 24 with one another at the first countersunk openings 22R1, 24R1 of the sets of rear countersunk opening 22R, 24R and countersunk openings 26E, 28E of the first and second pegs 26, 28. In the present disclosure, the first and second housings 22, 24 include a threading (not shown) in first countersunk openings 22R1, 24R1 of the sets of rear countersunk opening 22R, 24R to enable the second and third fasteners 80B, 80C to threadably engage with the first and second housings 22, 24. In the present disclosure, the first and second housings 22, 24 also include a threading (not shown) in countersunk openings 26E, 28E of the sets of first and second pegs 26, 28 to enable the second and third fasteners 80B, 80C to threadably engage with the first and second housings 22, 24. Once the set of fasteners 80 hold the main body 20 together, the jaw assembly 30, the first trigger component 50, the second trigger component 60, and the biasing assembly 70 are held and maintained inside of the main body 20.

Archery release 10 may also include a wrist strap assembly 90 that operably engages with the main body 20. In the present disclosure, wrist strap assembly 90 may be wrapped around and fastened to an archer's wrist to enable the archer to draw the archery release 10 with large muscle groups found in the archer's shoulders, the archer's back, the archer's arms, and the archer's core. Such components and elements of wrist strap assembly 90 are discussed in greater detail below.

Figure 9A:
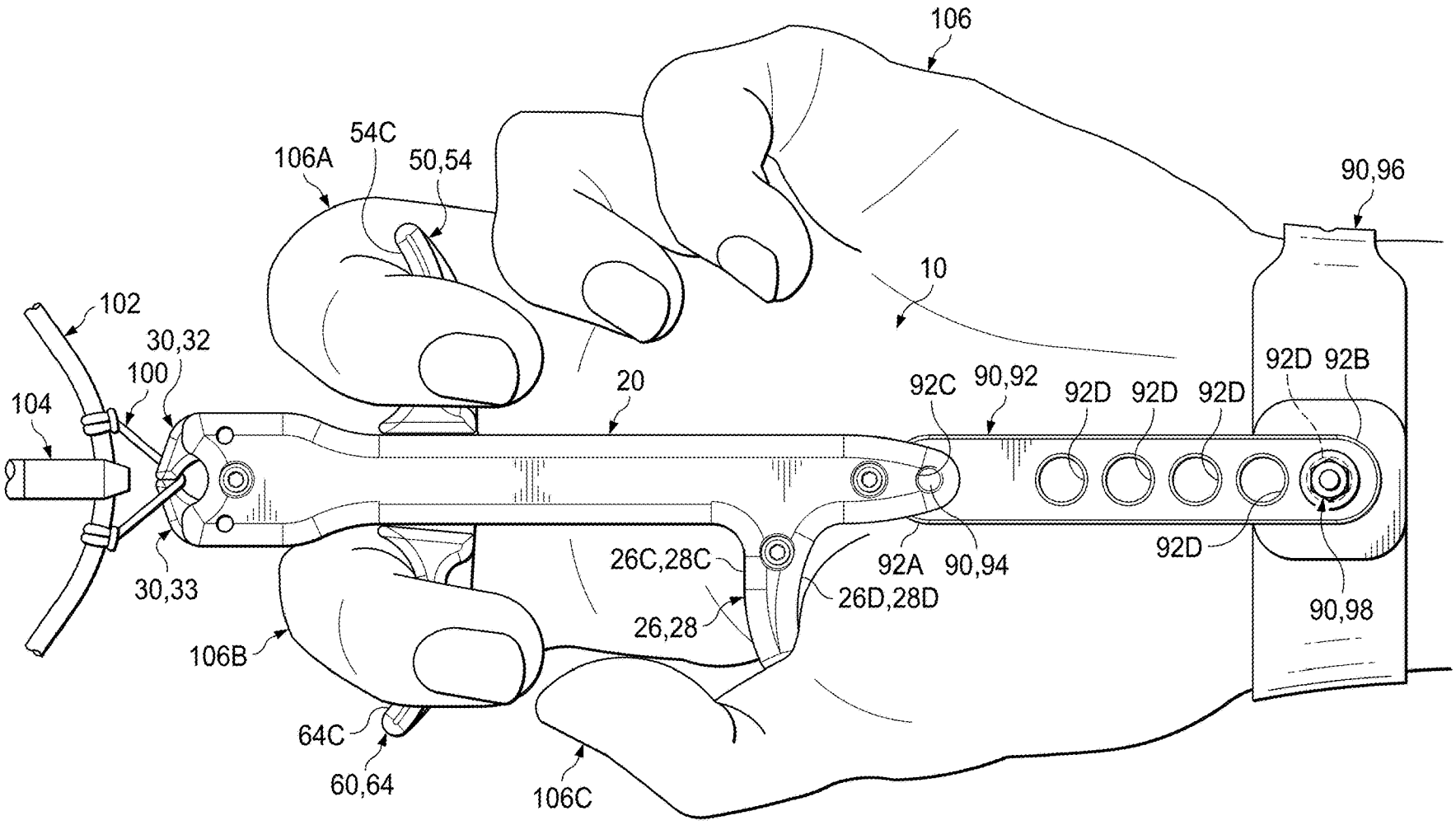
FIG. 9A (FIG. 9A) is an operational view of the archery release, wherein the archery release is loaded with a D-loop of a bowstring of a bow that holds an arrow and is grasped by an archer at a safety position.
Figure 9B:
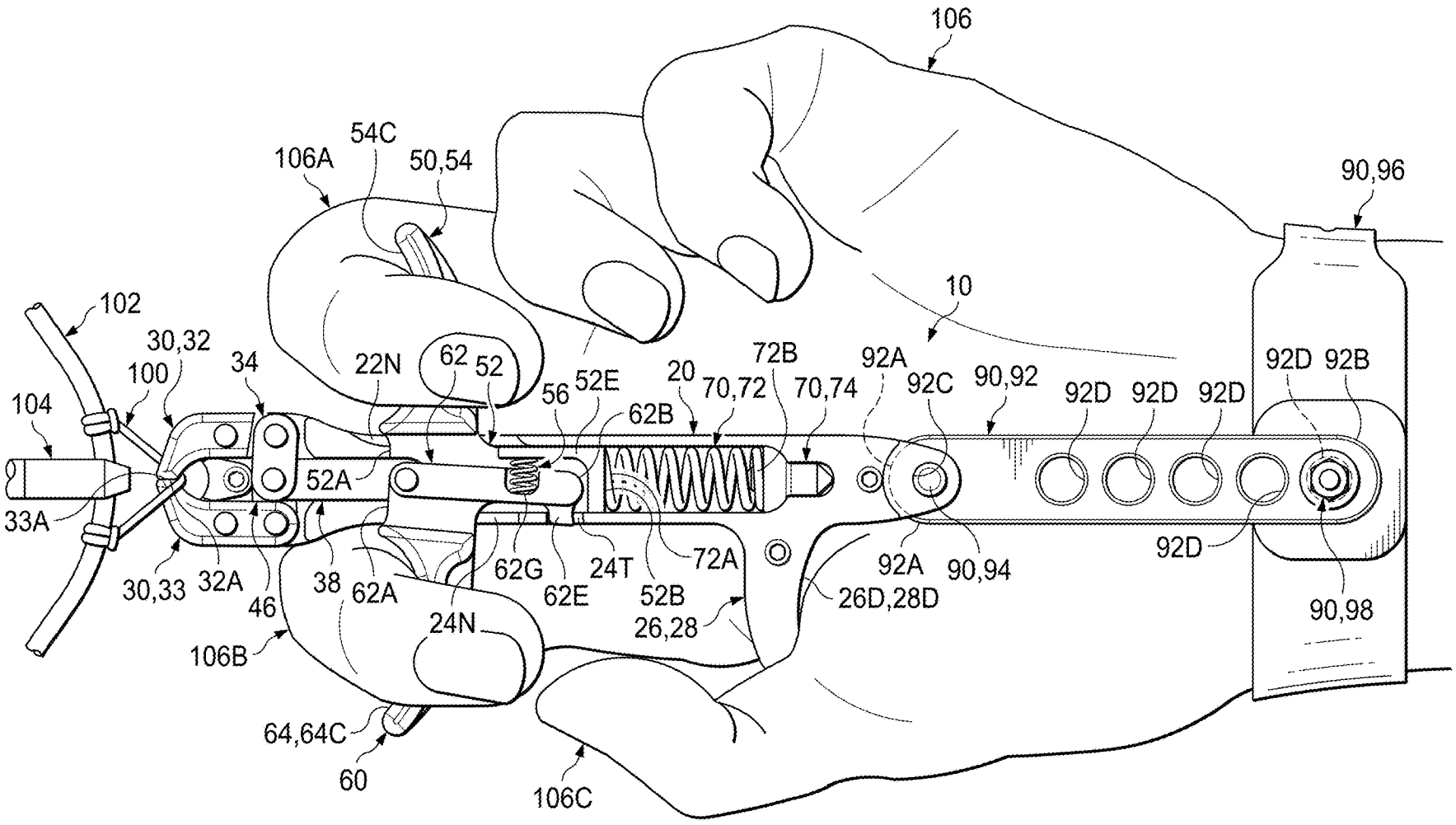
FIG. 9B (FIG. 9B) is another operational view similar to FIG. 9A where the archery release is provided at the safety position.

Wrist strap assembly 90 includes an adapter plate 92 that operably engages with main body 20 via an attachment pin 94. As best seen in FIGS. 1 and 9B, adapter plate 92 includes a front end 92A that is positioned inside of the main body 20, a rear end 92B opposite to the front end 92A and spaced apart from the front end 92A, and a longitudinal axis defined therebetween. Adapter plate 92 also defines an attachment through-hole 92C at the front end 92A of the adapter plate 92. In the present disclosure, attachment through-hole 92C is configured to receive to receive a portion of the attachment pin 94 to enable the attachment pin 94 to pivotably engage the adapter plate 92 with the main body 20. Upon assembly, the second countersunk openings 22R2, 24R2 of the sets of the rear countersunk openings 22R, 24R of the first and second housings 22, 24 and the attachment through-hole 92C of the adapter plate 92 are coaxial with one another to enable the attachment pin 94 to pivotably engage said adapter plate 92 with said main body 20.

Still referring to adapter plate 92, adapter plate 92 also defines at least one securement through-hole 92D. As best seen in FIGS. 1 and 9B, adapter plate 92 defines a set of securement through-holes 92D between the rear end 92B of the adapter plate 92 to a location defined between front end 92A and the rear end 92B. In the present disclosure, the adapter plate 92 defines five securement through-holes 92D. In operation, a wrist strap 96 of the wrist strap assembly 90 may be secured with the adapter plate 92 at any one of the securement through-holes 92D of the set of securement through-holes 92D by a securement assembly 98 (e.g., a fastener threadably engaged with a nut). Such set of securement through-holes 92D enables the archer to vary the distance between the main body 20 and the wrist strap 96 for various archery reasons, including the length of the archer's arm, the length and/or distance of the archer's draw, the size of the archer's hand, a preferred or desired wrist strap location for the archer, and other various archery reasons of the like.

While adapter plate 92 defines five securement through-holes 92D, adapter plate 92 may define any suitable number of securement through-holes, slots, or openings for enabling an archer to secure a wrist strap with the adapter plate 92. Examples of suitable numbers of securement through-holes for an adapter plate include at least one, two, a plurality, three, four, five, six, and other suitable numbers of securement through-holes for an adapter plate.

Having now described the components and elements of archery release 10, a method of using archery release 10 is discussed in greater detail below.

Prior to engaging and/or actuating the jaw assembly 30, the first trigger component 50, and the second trigger component 60, an archer may first wrap and attach the wrist strap 96 to the archer's desired wrist. As discussed above, the wrist strap 96 enables the archer to draw the archery release 10 with large muscle groups found in the archer's shoulders, the archer's back, the archer's arms, and the archer's core. Optionally, archer may also adjust the distance of the wrist strap 96 relative to the main body 20 by securing the wrist strap 96 with the adapter plate 92 at any of the securement through-holes of the set of securement through-holes 92D by the securement assembly 98. While not demonstrated herein, a D-loop 100 of a bowstring 102 is also loaded into the jaw assembly 30 by the archer prior to loading a bolt or arrow 104 with the bowstring 102 (see FIG. 9A); such actions of opening and closing the jaw assembly 30 with the first trigger component 50 and the second trigger component 60 are discussed in greater detail below. It should be noted that the archer may grip or grasp the pair of pegs 26, 28 when loading the D-loop of the bowstring 102 into the first jaw 32 and the second jaw 33 with an archer's digit or archer's thumb. Such gripping of the pair of pegs 26, 28 with the archer's thumb may enhance and/or increase the grip strength of the archer when loading the D-loop of the bowstring 102 into the first jaw 32 and the second jaw 33.

Once the D-loop 100 is secured in the jaw assembly 30 and the arrow 104 is engaged with the bowstring 102, the archer may then proceed to draw the bowstring 102 and the arrow 104 in a rearward direction by the wrist strap assembly 90, particularly the wrist strap 96. Such use of drawing the bowstring 102 with the wrist strap 96 enables the archer to utilize larger muscles groups found in the archer's shoulders, the archer's back, the archer's arms, and the archer's core. Such use of these larger muscle groups assists the archer in drawing the bowstring to a firing or full draw position while also preventing fatigue in the archer's small muscle groups (e.g., the archer's arms and the archer's hands). As the archer draws the bowstring 102 and the arrow 104 with the wrist strap 96, the archer is free from gripping or actuating the first trigger component 50 and the second trigger component 60 to avoid inadvertent and/or accidental release of the bowstring 102 from the archery release 10 and inadvertently firing of the arrow 104.

Once the archer reaches a firing or full draw position with the archery release 10, the archer may then grip the main body 20, the first trigger component 50, and the second trigger component 60 with an archer's hand 106. As best seen in FIG. 9A, the archer may grip the first trigger component 50 (particularly the front grip surface 54C of trigger 54) with a first digit or long finger 106A and grip the second trigger component 60 with a second digit or index finger 106B (particularly the front grip surface 64C of trigger 64). Still referring to FIG. 9A, the archer may also rest or engage a third digit or thumb 106C with the pair of pegs 26, 28 of the main body 20 while the first digit 106A and the second digit 106B are engaged with the first trigger component 50 and the second trigger component 60.

Figure 9C:
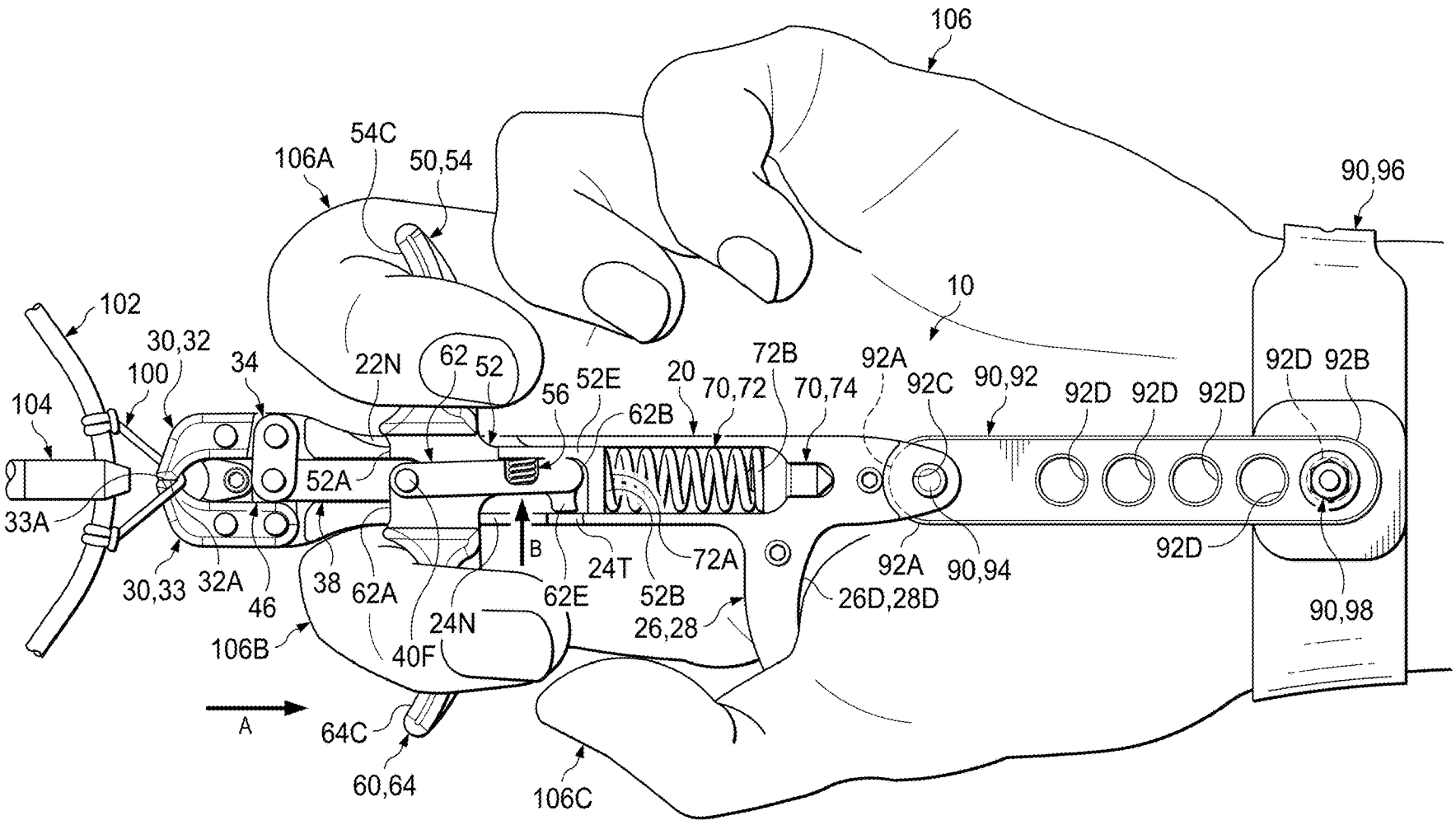
FIG. 9C (FIG. 9C) is another operational view similar to FIG. 9B, but a first digit of the archer deactivates a safety trigger of the archery release from the safety position to a firing position.

Once the triggers 54, 64 of the first trigger component 50 and the second trigger component 60 are engaged by the archer, the archer may then disengage the second trigger component 60 from a safety position to a fire position. As mentioned above, the safety member 62E of the second trigger component 60 is engaged with the main body 20 to maintain the first trigger component 50 and the second trigger component 60 in the safety position. Particularly, the safety member 62E of the second trigger component 60 is engaged with the second housing 24 inside of the safety aperture 24T to maintain the first trigger component 50 and the second trigger component 60 in the safety position. As best seen in FIG. 9C, the archer may actuate or move the second trigger component 60 from the safety position (see FIG. 9B) to the fire position (see FIG. 9C) by applying a first force on the trigger 64 of the second trigger component 60 in a rearward direction; such first force applied on the trigger 64 of the second trigger component 60 by the archer is denoted by an arrow labeled "A" in FIG. 9C. As the first force is applied by the archer, the second trigger component 60 pivots or rotates about the sixth dowel 40F of the set of dowels 40 causing the base member 62 of the second trigger component 60 to compress biaser 56 upwardly into the base member 52 of first trigger component 50; such compression of biaser 56 is denoted by arrow labeled "B" in FIG. 9C. In this instance, the force applied on the biaser 56 by the archer is greater than the biasing power and/or tensile strength of the biaser 56 to maintain the safety member 62E engaged with the main body 20. Once the safety member 62E disengages from the main body 20 and is outside of the safety aperture 24T, the second trigger component 60 is then provided in the firing position enabling the archery release 10 to fire the arrow 104.

Figure 9D:
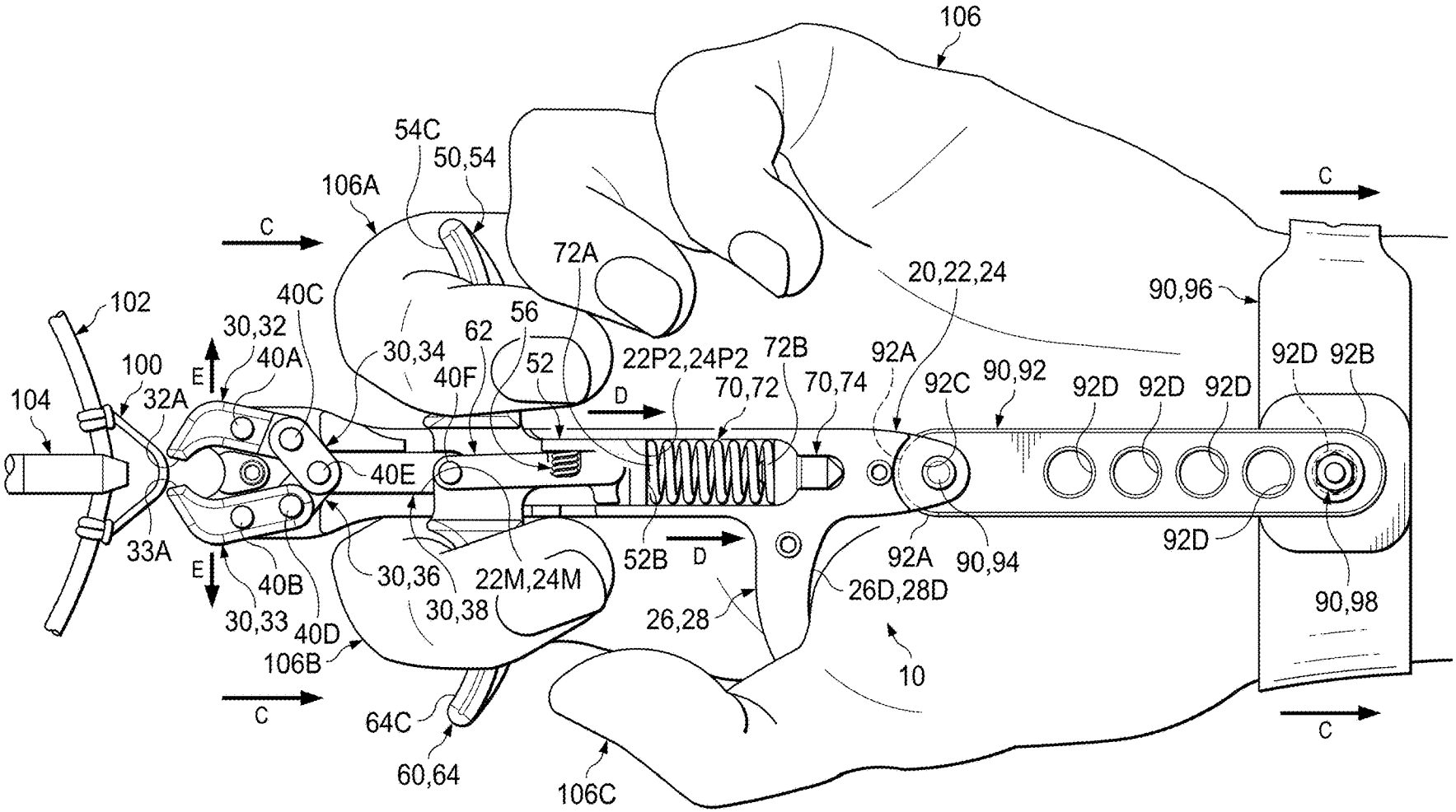
FIG. 9D (FIG. 9D) is another operational view similar to FIG. 9C, but the archer draws the archery release with a wrist strap assembly at a full draw causing the first and second digits of the archer to pull the safety trigger and the firing trigger from a first position to a second position to release the D-loop and firing the arrow.

Once the second trigger component 60 is provided in the firing position, the archer then beings to the draw the bowstring 102 in the rearward direction (i.e., pulling throw the shot) by using the wrist strap 96 of archery release 10 to fire the arrow 104 down range at a target. Prior to drawing the archery release 10, the jaw assembly 30 is provided in a closed position (see FIGS. 10A-10C) to maintain the D-loop 100, the bowstring 102, and the arrow 104 with the archery release 10. As the archer begins to draw the bowstring 102 with the wrist strap 96, the archer transfers and applies a rearward force on the first trigger component 50, at the first digit 106A, and to the second trigger component 60, at the second digit 106B, so that the first trigger component 50 and the second trigger component 60 travel simultaneously in a rearward direction towards the rear end 22B, 24B of first and second housings 22, 24; such force transferred and applied to the first trigger component 50 and the second trigger component 60 when the archer draws the bowstring 102 with the wrist strap 96 is denoted by arrows labeled "C" in FIG. 9D. As best seen in FIG. 9D, the base members 52, 62 of the first trigger component 50 and the second trigger component 60 also ride along the second interior walls 22P2, 24P2 of the main body 20 inside of the second recesses 22P1, 24P1 as the first trigger component 50 and the second trigger component 60 are actuated by archer. Stated differently, the base members 52, 62 of the first trigger component 50 and the second trigger component 60 are guided by the second interior walls 22P2, 24P2 of the main body 20 inside of the second recesses 22P1, 24P1 as the first trigger component 50 and the second trigger component 60 are actuated by archer.

As the first trigger component 50 and the second trigger component 60 travel in the rearward direction, the first trigger component 50 and the second trigger component 60 compress the main biaser 72 from a first or expanded position (see FIG. 9C) to a second or compressed position (see FIG. 9D). Such compression of the main biaser 72 from the expanded position to the compressed position is denoted by an arrow labeled "D" in FIG. 9D. In the present disclosure, the force applied to the first trigger component 50 and the second trigger component 60 by the archer overcomes the biasing force of the main biaser 72 which compresses the main biaser 72 and allows for release of the D-loop 100 at a desired draw position. As described above, main biaser 72 is configured to bias the first trigger component 50 and the second trigger component 60 to the first position (See FIGS. 9A-9C) to avoid accidental opening and/or release of the D-loop 100 of the bowstring 102 when the archer begins to draw the bowstring 102.

As the first trigger component 50 and the second trigger component 60 travel in the rearward direction, the components of the jaw assembly 30 move in conjunction with the first trigger component 50 and the second trigger component 60 to provide the jaw assembly 30 in the opened position.

First, the trigger link 38 moves rearward with the first trigger component 50 and the second trigger component 60 due to the sixth dowel 40F linking the trigger link 38 with the first trigger component 50 and the second trigger component 60. As best seen in FIGS. 9C-9D, the trigger link 38 rides along and/or is guided by the tracks 22M, 24M of the first and second housings 22, 24 of main body 20 as the first trigger component 50 and the second trigger component 60 are moved in the rearward direction.

Second, the first cam link 34 and the second cam link 36 then move rearward with the trigger link 38 due to the third dowel 40C, the fourth dowel 40D, and the fifth dowel 40E linking the first cam link 34 and the second cam link 36 with the trigger link 38 (see FIGS. 9C-9D). With respect to the first cam link 34, the second end 34B of the first cam link 34 shifts rearward towards the trigger link 38 and pivots towards the rear ends 22B, 24B of first and second housings 22, 24 as the third dowel 40C and the fifth dowel 40E ride along and/or are guided by the first interior walls 22K2, 24K2 of the first and second housings 22, 24 when pulled by the trigger link 38. With respect to the second cam link 36, the second end 36B of the second cam link 36 also shifts rearward towards the trigger link 38 and pivots towards the rear ends 22B, 24B of first and second housings 22, 24 as the fourth dowel 40D and the fifth dowel 40E ride along and/or are guided by the first interior walls 22K2, 24K2 of the first and second housings 22, 24 when pulled by the trigger link 38. Such pivoting movement causes the first end 34A of the first cam link 34 and the first end 36A of the second cam link 36 to move forwardly towards one another due to the movement of the third dowel 40C and the fourth dowel 40D.

Third, the pair of jaws 32, 33 then move and/or pivot with the first cam link 34 and the second cam link 36 from the closed position (see FIGS. 10A-10C) to the open positioned (see FIG. 9D) due to the first dowel 40A, the second dowel 40B, and the third dowel 40C linking the pair of jaws 32, 33 with the first cam link 34 and the second cam link 36. With respect to the first jaw 32, the base 33B of the first jaw 32 pivots downwardly and/or inwardly towards the trigger link 38 as the third dowel 40C rides along and/or is guided by the first interior walls 22K2, 24K2 of the first and second housings 22, 24 when pulled by the first cam link 34. Similarly, with respect to the second jaw 33, the base 33B of the second jaw 33 pivots upwardly and/or inwardly towards the trigger link 38 as the fourth dowel 40D rides along and/or is guided by the first interior walls 22K2, 24K2 of the first and second housings 22, 24 when pulled by the second cam link 36. It should be understood that the bases 32B, 33B of the first jaw 32 and the second jaw 33 pivot simultaneously towards one another as the first cam link 34 and the second cam link 36 are pulled by the trigger link 38 (see FIG. 9D).

Still referring to the pair of jaws 32, 33, the tips 32A, 33A of the first jaw 32 and the second jaw 33 also pivot outwardly from one another from the closed position (see FIGS. 9A-9C) to the open positioned (see FIG. 9D) due to the first dowel 40A, the second dowel 40B, and the third dowel 40C linking the pair of jaws 32, 33 with the first cam link 34 and the second cam link 36. With respect to the first jaw 32, the tip 32A of the first jaw 32 pivots upwardly and/or outwardly about the first dowel 40A and away from the tip 33A of the second jaw 33 when pulled by the first cam link 34. Similarly, with respect to the second jaw 33, the tip 33A of the second jaw 33 pivots upwardly and/or outwardly about the second dowel 40B and away from the tip 32A of the first jaw 32 when pulled by the second cam link 36. It should be understood that the tips 32A, 33A of the first jaw 32 and the second jaw 33 pivot simultaneously away from one another as the first cam link 34 and the second cam link 36 are pulled by the trigger link 38 (see FIG. 9D). Such pivoting of the tips 32A, 33A of the first jaw 32 and the second jaw 33 are denoted by arrows labeled "E" in FIG. 9D.

Once the tips 33A of the first jaw 32 and the second jaw 33 disengage from one another and pivot to the open position, the D-loop 100 is released at a desired tension causing the bowstring 102 to move away from the archery release 10 and firing the arrow 104 from the bowstring 102. It should be noted that the first jaw 32 and the second jaw 33 pivot simultaneously from the closed position to the open position such that the tips 32A, 33A and/or other portions of the first jaw 32 and the second jaw 33 are free from interfering with the D-loop 100 once released. Based on the structural configuration of the pair of jaw 32, 33, the tips 32A, 33A of the first jaw 32 and the second jaw 33 are directly in line with the nock point of the bow as well as the shaft of the arrow 104 which prevents interferences with the D-loop 100 once the first jaw 32 and the second jaw 33 release the D-loop 100.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. An archery release, comprising:

a main body;

a jaw assembly operably engaging with the main body that is adapted to receive and hold a D-loop formed on a bowstring;

a pair of triggers operably engaging with the jaw assembly for moving the jaw assembly between an open position and a closed position; and a biaser operably engaging with the main body and at least one trigger of the pair of triggers for biasing the pair of triggers towards the closed position;

wherein when the pair of triggers moves from a first position to a second position, a first jaw and a second jaw of the jaw assembly simultaneously transition from the closed position to the open position.

2. The archery release of claim 1, further comprising:

a safety mechanism operably engaging with a first trigger or a second trigger of the pair of triggers and the main body;

wherein the safety mechanism is configured to prevent the pair of triggers from moving from the closed position to the open position.

3. The archery release of claim 2, wherein the safety mechanism comprises:

a safety member extending from the first trigger or the second trigger of the pair of triggers that is configured to engage with the main body.

4. The archery release of claim 3, wherein the safety mechanism comprises:

a safety aperture defined in the main body, wherein the safety member is operably engageable with the main body inside of the safety aperture.

5. The archery release of claim 4, wherein when the safety member is positioned inside of the safety aperture, the archery release is provided in a safety position.

6. The archery release of claim 4, wherein when the safety member is positioned outside of the safety aperture, the archery release is provided in a firing position.

7. The archery release of claim 1, wherein the pair of triggers further comprises:

a first base of a first trigger component of the pair of triggers that operably engages with the jaw assembly and with the biaser inside of said main body; and a first trigger of the first trigger component of the pair of triggers that operably engages with the first base and is positioned external to the main body.

8. The archery release of claim 7, wherein the pair of triggers further comprises:

a second base of a second trigger component of the pair of triggers that operably engages with the jaw assembly and is positioned inside of the first base of the first trigger component; and a second trigger of the second trigger component of the pair of triggers that operably engages with the second base and is positioned external to the main body, the second trigger having a safety members that operably engages with the main body to prevent the pair of triggers from moving from the closed position to the open position.

9. The archery release of claim 8, further comprising:

a trigger biaser extending from the first base and being received by the second base;

wherein the trigger biaser is configured to maintain the pair of triggers in the closed position.

10. The archery release of claim 1, wherein the jaw assembly further comprises:

a trigger link operably engaging with the pair of triggers;

a first cam link operably engaging the first jaw with the trigger link; and a second cam link operably engaging the second jaw with the trigger link.

11. The archery release of claim 10, wherein the jaw assembly further comprises:

a first dowel pivotably engaging the first jaw and the first cam link with one another;

a second dowel pivotably engaging the second jaw and the second cam link with one another; and a third dowel pivotably engaging the first cam link, the second cam link, and the trigger link with one another.

12. The archery release of claim 1, wherein the main body further comprises:

a peg extending from the main body and is positioned longitudinally behind the jaw assembly, the pair of triggers, and the biaser;

wherein the peg is aligned with one of the triggers of the pair of triggers.

13. The archery release of claim 1, further comprising:

a wrist strap assembly pivotably engaging with the main body and positioned longitudinally behind the jaw assembly and the pair of triggers.

14. A method of firing an arrow from a bow, comprising:

loading the arrow with the bow;

loading a D-loop formed on a bowstring of the bow with a jaw assembly of an archery release;

gripping a first trigger of a pair of triggers with a first digit;

gripping a second trigger of the pair of triggers with a second digit;

pulling the pair of triggers from a first position to a second position;

opening a first jaw component and a second jaw component of the jaw assembly simultaneously; and firing the arrow from the bow.

15. The method of claim 14, further comprising:

disengaging one or both of the first trigger and the second trigger of the pair of triggers from a safety position to a firing position.

16. The method of claim 15, wherein the step of disengaging one or both of the first trigger and the second trigger of the pair of triggers from the safety position to the firing position further comprising:

removing a safety member that is disposed on one of the first trigger and the second trigger from a safety aperture defined in main body.

17. The method of claim 15, further comprising:

biasing the pair of triggers to the safety position by a trigger biaser.

18. The method of claim 14, further comprising:

connecting a first cam link with a trigger link and the first jaw component;

connecting a second cam link with the trigger link and the second jaw component; and connecting the trigger link with the pair of triggers.

19. The method of claim 14, further comprising:

engaging a wrist strap assembly to a main body of the archery release;

installing a wrist strap of the wrist strap assembly with a wrist; and pulling the wrist strap assembly simultaneously with the pair of triggers.

20. The method of claim 14, further comprising:

gripping a peg of a main body of the archery release with a third digit.

* * * * *